US009878226B2

(12) United States Patent
Nardini

(10) Patent No.: US 9,878,226 B2
(45) Date of Patent: Jan. 30, 2018

(54) CLEANING DEVICE

(71) Applicant: Douglas Nardini, Pueblo, CO (US)

(72) Inventor: Douglas Nardini, Pueblo, CO (US)

( * ) Notice: Subject to any disclaimer, the term of this patent is extended or adjusted under 35 U.S.C. 154(b) by 0 days.

(21) Appl. No.: 14/829,462

(22) Filed: Aug. 18, 2015

(65) Prior Publication Data

US 2016/0045796 A1 Feb. 18, 2016

Related U.S. Application Data

(60) Provisional application No. 62/038,633, filed on Aug. 18, 2014.

(51) Int. Cl.

| | |
|---|---|
| ***B08B 7/00*** | (2006.01) |
| ***A63B 57/00*** | (2015.01) |
| ***A46B 11/08*** | (2006.01) |
| ***A46B 11/00*** | (2006.01) |

(52) U.S. Cl.
CPC ..... *A63B 57/0087* (2013.01); *A46B 11/002* (2013.01); *A46B 11/08* (2013.01); *A46B 2200/3073* (2013.01)

(58) Field of Classification Search
None
See application file for complete search history.

(56) References Cited

U.S. PATENT DOCUMENTS

| | | | | |
|---|---|---|---|---|
| 5,277,209 | A * | 1/1994 | Olson | B08B 3/006 134/172 |
| 7,273,422 | B2 | 9/2007 | Vokey et al. | |
| 2002/0148066 | A1* | 10/2002 | Bullis | A47L 11/03 15/321 |
| 2003/0127543 | A1* | 7/2003 | Rieger | F02M 53/04 239/584 |
| 2009/0065607 | A1* | 3/2009 | Gardner | F16L 37/248 239/127 |
| 2011/0091339 | A1 | 4/2011 | Huang | |
| 2014/0083456 | A1* | 3/2014 | Ramsey | B08B 7/04 134/9 |

OTHER PUBLICATIONS

"Streetwize Portable Power Washer," Go Outdoors, 2013, retrieved from http://web.archive.org/web/20130622035058/http://www.gooutdoors.co.uk/streetwize-portable-power-washer-p199662?#, retrieved on May 10, 2016, 2 pages.

* cited by examiner

*Primary Examiner* — Binh X Tran
*Assistant Examiner* — David Cathey, Jr.
(74) *Attorney, Agent, or Firm* — Lewis Brisbois Bisgaard & Smith LLP

(57) ABSTRACT

A golf equipment cleaning device is provided wherein the cleaning device selectively expels a pressurized fluid that a golfer may use at any point on the golf course. A golfer may use a hand pump to pressurize a container that comprises a fluid. Then, the golfer may release the pressurized fluid through the end of a bristled brush such that the golfer may scrub a golf ball or golf club with a bristled brush and a pressurized fluid.

7 Claims, 22 Drawing Sheets

CLEANING DEVICE

This application claims the benefit of U.S. Provisional Patent Application Ser. No. 62/038,633, filed Aug. 18, 2014, the entire disclosure of which is incorporated by reference herein.

FIELD OF THE INVENTION

Embodiments of the present invention are generally related to cleaning devices. One embodiment of the present invention is used to clean golf equipment, such as golf clubs and golf balls.

BACKGROUND OF THE INVENTION

The modern game of golf originated in Scotland during the 15th century. Today, the sport enjoys massive popularity from children and casual players to professional golfers who compete for multi-million dollar payouts. Modern golf equipment includes an array of golf balls, clubs, bags, shoes, etc. Originally, golf balls were hard wooden spheres, then by the 17th and 18th centuries golf balls progressed to stuffed leather pouches. Modern golf balls first appeared in the early 19th century in the form of wound rubber balls. Inventors also discovered that placing dimples on the ball improved the trajectory of the golf ball by reducing drag the golf ball experiences during flight. The dimples also improve golf ball spin and control. Modern golf balls may include 250-450 dimples. The dimples and the golf ball must remain clean for the golf ball to function as designed.

Golf clubs have also developed since the emergence of modern golf in 15th century Scotland. Originally, golf clubs were made entirely from wood. Development of the golf club has produced clubs with metal heads and graphite shafts. Development of the golf club has also produced specialized features such as grooved heads. Club head grooves or scores allow a golfer to put more spin on the golf ball or channel water and debris away from the club face. A golf club with grooves on the club face is described in greater detail in U.S. Pat. No. 7,273,422, which is incorporated in its entirety by reference herein. After using a golf club in the rough, creating a divot in the ground, or shooting from a bunker, the club face may accumulate dirt and debris in the club face grooves. The debris can reduce the spin effect the grooves impart on the ball, or reduce the ability to channel dirt and debris from the club face, which reduces the club's effectiveness.

Dirt and debris can also impact golf ball effectiveness. Sand bunkers, water hazards, roughs with tall grass, etc. may cause dirt and debris to accumulate in the golf ball dimples, which adversely affects golf ball aerodynamics. Therefore, golfers frequently need to clean their golf balls to maintain the flight characteristics of the golf ball.

Golf courses often provide upright golf ball washers stationed periodically throughout a golf course, often at the beginning of a hole near the tee box. Golf ball washers comprise a closed chamber with brushes and cleaning solution. An agitator assembly is disposed through the closed chamber and comprises an aperture. A golfer places a dirty golf ball in the aperture of the agitator assembly, then reciprocates the agitator assembly such that the golf ball travels into the closed body and is cleaned by the brushes and cleaning solution. While upright golf ball cleaning machines can clean golf balls, they are usually only stationed at a few locations on a golf course, typically near the tee boxes. However, golf balls can become dirty at any point on the golf course; e.g., a golfer can slice a ball into a sand bunker or rough grass at any point. It is impractical to post upright golf ball cleaners at every location where a golf ball may become dirty. Further, the brush and cleaning solution combination is not necessarily efficient when cleaning a golf ball because a golf ball may comprise 250-450 dimples. A given dimple would need to encounter several brush bristles at multiple angles. More importantly, course operators rarely change the cleaning solution in the cleaners. Thus, golfers sometimes clean their golf equipment with spit or employ other unsanitary practices, which can later contaminate the cleaning solution and the golf balls cleaners.

A golfer often carries items to clean his golf balls or clubs during play. For example, a golfer may carry a rag to wipe down a dirty golf ball. However, a rag is not efficient in cleaning out individual dimples on a golf ball, and a golfer will either have to interrupt play to clean each dimple on a golf ball or accept a dirty golf ball with inferior flight characteristics. Further, rags are rarely cleaned and golfers use spit to wet the rags, which is not sanitary.

The options for cleaning a golf club face, specifically the grooves on the club face, are even fewer than the options for cleaning a golf ball. Most golf courses do not have periodic stations for cleaning the grooves on a golf club face. Rather, a golfer must carry a brush for cleaning the club face. Further, the golfer must be careful not to use a wire-bristled brush so not to scratch or mar the club face.

Thus it is a long felt need to provide a golf equipment cleaning device that allows for easy cleaning of any piece of golf equipment. The following disclosure describes an improved golf equipment cleaning device that allows the user to clean golf equipment at any point on a golf course.

SUMMARY OF THE INVENTION

It is one aspect of some embodiments of the present invention to provide a golf equipment cleaning device that utilizes pressurized fluid to clean golf equipment. It is a further aspect of embodiments of the present invention to provide a portable golf equipment cleaning device.

It is one aspect of some embodiments of the present invention to provide a golf equipment cleaning device powered by a variety of power sources. In one embodiment, a hand pump is used to compress gas or liquid in a central chamber of the cleaning device. In other embodiments, a bicycle pedal is operatively connected to the cleaning device to drive a pump. In yet other embodiments, the cleaning device is associated with a pump operatively connected to the electric power source of a golf cart or any other electric system. This includes inductive electric systems wherein specialized pads may be on a golf cart or through a golf course, and the pads create an alternating electric field which powers the cleaning device. Some contemplated devices include a squeezable water bottle used to pressurize cleaning fluid.

It is another aspect of some embodiments of the present invention to provide a golf equipment cleaning device that may be utilized in a variety of locations. Embodiments of the present invention may be portable, semi-portable, or fixed to another device or the environment. Portable cleaning devices are self-contained and need not be physically connected to one or more external power sources; these embodiments include cleaning device powered by hand, solar, or induction power sources. Semi-permanent cleaning devices are largely self-contained but may be physically connected to an external power source, including power outlets, pedal-powered pumps, or hydraulic fluid lines. Finally, permanent cleaning devices are fixed in their location and are physically connected to one or more power sources.

It is one aspect of some embodiments of the present invention to provide a golf equipment cleaning device that may comprise a variety of differently shaped containers. In some embodiments, the container may be a conventional shape, such as a generally cylindrical vessel. In other embodiments, the container may be shaped to suit various purpose or environments. For example, a container may be shaped to conform to a portion of a golf cart or a golf bag to create a more stable interface between the container and the golf car or golf bag. One skilled in the art will appreciate other objects that a container may be contoured to provide an improved interface.

It is another aspect of some embodiments of the present invention to provide a golf equipment cleaning device that may entrain additional liquid or vapor into a pressurized stream of fluid. In some embodiments of the present invention, the container contains a fluid such as water. The container is pressurized such that the water is expelled as a fluid mist or vapor or combination thereof through a container outlet. At a downstream location, additional liquid or vapor may be entrained into the flow of the water to modify the characteristics of the water. In some embodiments of the present invention, a user may selectively entrain additional liquid or vapor into a pressurized stream of fluid via a valve, gates, selective connection, or other similar means typically used in the art.

It is a further aspect of some embodiments of the present invention to provide a golf equipment cleaning device that comprises various brush configurations. Some embodiments of the present invention comprise a single, general purpose brush. In other embodiments, the brush may be removable from the valve or hose to which it is connected, and the brush and its bristles may be configured for specialized applications. For example, one brush may be configured to clean a golf ball while another brush may be configured to clean a golf club.

It is an addition aspect of various embodiments of the present invention to provide a golf equipment cleaning device that may be used as a misting device for a variety of purposes. Similar to other embodiments described herein, a mister may be used to clean objects that have an accumulation of dirt and debris. In further embodiments, a mister may cool a person on a hot day, to increase the humidity of a closed space, etc.

Further aspects of the present invention are provided in the following embodiments:

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, wherein the brush comprises a primary valve stem connected to the hose; a first stem in fluid communication with the primary valve stem; a second stem in fluid communication with the primary valve stem; a first plurality of bristles disposed on a distal end of the first stem, wherein a portion of the fluid flows through the primary valve stem, through the first stem, and past the first plurality of bristles; and a second plurality of bristles disposed on a distal end of the second stem, wherein a portion of the fluid flows through the primary valve stem, through the second stem, and past the second plurality of bristles.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, wherein the brush comprises a primary valve stem connected to the hose; a first stem in fluid communication with the primary valve stem; a second stem in fluid communication with the primary valve stem; a first plurality of bristles disposed on a distal end of the first stem, wherein a portion of the fluid flows through the primary valve stem, through the first stem, and past the first plurality of bristles; and a second plurality of bristles disposed on a distal end of the second stem, wherein a portion of the fluid flows through the primary valve stem, through the second stem, and past the second plurality of bristles, wherein the first plurality of bristles and the second plurality of bristles are oriented about a radius of curvature, wherein the radius of curvature is between approximately 0.5 inches and 2.5 inches.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, wherein the brush comprises a primary valve stem interconnected to the valve, the primary valve stem having a longitudinal axis; a first stem in fluid communication with the primary valve stem; a second stem in fluid communication with the primary valve stem; a third stem in fluid communication with the primary valve stem, wherein the first stem, the second stem, and the third stem are symmetrical about the longitudinal axis of the primary valve stem; a first plurality of bristles disposed on a distal end of the first stem, wherein a portion of the fluid flows through the primary valve stem, through the first stem, and past the first plurality of bristles; a second plurality of bristles disposed on a distal end of the second stem, wherein a portion of the fluid flows through the primary valve stem, through the second stem, and past the second plurality of bristles; and a third plurality of bristles disposed on a distal end of the third stem, wherein a portion of the fluid flows through the primary valve stem, through the third stem, and past the third plurality of bristles.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, wherein the brush comprises a primary valve stem interconnected to the valve, the primary valve stem having a longitudinal axis; a first stem in fluid communication with the primary valve stem; a second stem in fluid communication with the primary valve stem; a third stem in fluid communication with the primary valve stem, wherein the first stem, the second stem, and the third stem are symmetrical about the longitudinal axis of the primary valve stem; a first plurality of bristles disposed on a distal end of the first stem, wherein a portion of the fluid flows through the primary valve stem, through the first stem, and past the first plurality of bristles; a second plurality of bristles disposed on a distal end of the second stem, wherein a portion of the fluid flows through the primary valve stem, through the second stem, and past the second plurality of bristles; and a third plurality of bristles disposed on a distal end of the third stem, wherein a portion of the fluid flows through the primary valve stem, through the third stem, and past the third plurality of bristles, wherein the first plurality of bristles, the second plurality of bristles, and the third plurality of bristles are oriented about a radius of curvature, wherein the radius of curvature is between approximately 0.5 inches and 2.5 inches.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, wherein the brush comprises; a primary valve stem connected to the valve; a first substantially planar member hingedly connected to a distal end of the primary valve stem; a second substantially planar member hingedly connected to the distal end of the primary valve stem, wherein the second substantially planar member is disposed opposite the first substantially planar member; a first plurality of bristles disposed on an inner surface of the first substantially planar member; a second plurality of bristles disposed on an inner surface of the second substantially planar member; and wherein the first and second substantially planar members are rotatable such that the first and second plurality of bristles may overlap.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, further comprising: a second container having a second container outlet; a second hose connected to the second container outlet, and a Y connection of the hose, wherein the second container is in fluid communication with the hose; and wherein an entrained fluid is adapted to be held within the second container, wherein when the fluid flows through the hose, the entrained fluid is at least partially moved out of the second container and into contact with fluid flowing through the hose.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, wherein the brush comprises a primary valve stem connected to the hose; a first stem in fluid communication with the primary valve stem; a second stem in fluid communication with the primary valve stem; a first plurality of bristles disposed on a distal end of the first stem, wherein a portion of the fluid flows through the primary valve stem, through the first stem, and past the first plurality of bristles; and a second plurality of bristles disposed on a distal end of the second stem, wherein a portion of the fluid flows through the primary valve stem, through the second stem, and past the second plurality of bristles, further comprising: a heating element disposed about the primary valve stem of the brush, wherein engagement of the valve causes the heating element to heat the primary valve stem and the fluid.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, further comprising: a pedal operatively connected to the valve, wherein a user may depress the pedal to open the valve.

A cleaning device, comprising: a container adapted for holding fluid having an opening and an outlet; a pump device connected to the opening of the container; a hose connected to the outlet of the container; a valve associated with the hose, wherein the container, the pump device, the hose, and the valve at least partially define a hermetically sealable volume; and a brush connected to the hose, the brush comprising at least one brush outlet to dispense the fluid when the valve is opened, wherein the brush comprises a primary valve stem connected to the hose; a first stem in fluid communication with the primary valve stem; a second stem in fluid communication with the primary valve stem; a first plurality of bristles disposed on a distal end of the first stem, wherein a portion of the fluid flows through the primary valve stem, through the first stem, and past the first plurality of bristles; and a second plurality of bristles disposed on a distal end of the second stem, wherein a portion of the fluid flows through the primary valve stem, through the second stem, and past the second plurality of bristles, further comprising: a handle disposed about the primary valve stem, wherein the valve is disposed within the handle, the valve comprising an actuator that protrudes through the handle.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; at least one additional stem connected to the valve stem, wherein a plurality of bristles is disposed on an inner surface of each additional stem; increasing the pressure within the hermetically sealable volume by engaging the pumping device; and releasing the fluid through the valve by engaging the valve, wherein the fluid flows through the valve stem, through the at least one additional stem, and past the plurality of bristles on the at least one additional stem.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; at least one additional stem connected to the valve stem, wherein a plurality of bristles is disposed on an inner surface of each additional stem; increasing the pressure within the hermetically sealable volume by engaging the pumping device; and releasing the fluid through the valve by engaging the valve, wherein the fluid flows through the valve stem, through the at least one additional stem, and past the plurality of bristles on the at least one additional stem, wherein the at least one additional stem is two additional stems.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; at least one additional stem connected to the valve stem, wherein a plurality of bristles is disposed on an inner surface of each additional stem; increasing the pressure within the hermetically sealable volume by engaging the pumping device; and releasing the fluid through the valve by engaging the valve, wherein the fluid flows through the valve stem, through the at least one additional stem, and past the plurality of bristles on the at least one additional stem, wherein the at least one additional stem is two additional stems, wherein the two additional stems are disposed about a longitudinal axis of the valve stem, and wherein a stem angle is formed between the two additional stems.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; at least one additional stem connected to the valve stem, wherein a plurality of bristles is disposed on an inner surface of each additional stem; increasing the pressure within the hermetically sealable volume by engaging the pumping device; and releasing the fluid through the valve by engaging the valve, wherein the fluid flows through the valve stem, through the at least one additional stem, and past the plurality of bristles on the at least one additional stem, wherein the at least one additional stem is two additional stems, wherein the two additional stems are disposed about a longitudinal axis of the valve stem, and wherein a stem angle is formed between the two additional stems, wherein the stem angle is approximately 180 degrees.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; at least one additional stem connected to the valve stem, wherein a plurality of bristles is disposed on an inner surface of each additional stem; increasing the pressure within the hermetically sealable volume by engaging the pumping device; and releasing the fluid through the valve by engaging the valve, wherein the fluid flows through the valve stem, through the at least one additional stem, and past the plurality of bristles on the at least one additional stem, further comprising: providing a second container adjacent to the container, the second container having a second outlet; providing a second hose connected to the second outlet and a Y connection of the hose, wherein the second container is in fluid communication with the hose; and providing an entrained fluid within the second container, wherein when the fluid flows through the hose, the entrained fluid is entrained out of the second container and into the fluid flowing through the hose.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; a first and second member extending from the valve stem, each member in fluid communication with the valve stem, wherein a plurality of bristles is disposed on an inner surface of each member; increasing the pressure within the hermetically sealable volume by engaging the pumping device; and releasing the fluid through the valve by engaging the valve, wherein the fluid flows through the valve stem, through the first and second members, and past the plurality of bristles disposed on an inner surface of each member.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; a first and second member extending from the valve stem, each member in fluid communication with the valve stem, wherein a plurality of bristles is disposed on an inner surface of each member; increasing the pressure within the hermetically sealable volume by engaging the pumping device; and releasing the fluid through the valve by engaging the valve, wherein the fluid flows through the valve stem, through the first and second members, and past the plurality of bristles disposed on an inner surface of each member, further comprising: a first flexible hose connected to a distal end of the valve stem and a back side of the first member; a second flexible hose connected to the distal end of the valve stem and a back side of the second member; wherein the first member is L shaped and hingedly connected to the valve stem, wherein the second member is L shaped and hingedly connected to the valve stem, and wherein engagement of the members with an object causes the members to rotate and press the plurality of bristles disposed on an inner surface of each member into the object.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; a first and second member extending from the valve stem, each member in fluid communication with the valve stem, wherein a plurality of bristles is disposed on an inner surface of each member; increasing the pressure within the hermetically sealable volume by engaging the pumping device; and releasing the fluid through the valve by engaging the valve, wherein the fluid flows through the valve stem, through the first and second members, and past the plurality of bristles disposed on an inner surface of each member, further comprising: providing a second container adjacent to the container, the second container having a second outlet; providing a second hose connected to the second outlet and a Y connection of the hose, wherein the second container is in fluid communication with the hose; and providing an entrained fluid within the second container, wherein when the fluid flows through the hose, the entrained fluid is entrained out of the second container and into the fluid flowing through the hose.

A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; a first and second member extending from the valve stem, each member in fluid communication with the valve stem, wherein a plurality of bristles is disposed on an inner surface of each member; increasing the pressure within the hermetically sealable volume by engaging the pumping device; and releasing the fluid through the valve by engaging the valve, wherein the fluid flows through the valve stem, through the first and second members, and past the plurality of bristles disposed on an inner surface of each member, further comprising: providing a heating element disposed about the valve stem of the brush, wherein engagement of the valve causes the heating element to heat the valve stem and the fluid. A method of cleaning an object, comprising: providing a container having an opening and an outlet, the container comprising a fluid; disposing a pump device on the opening of the container; providing a hose connected to the outlet; providing a valve connected to the hose, wherein the container, the pump device, the hose, and the valve at least partially define a hermetically sealable volume; providing a brush connected to the valve, the brush comprising: a valve stem connected to the valve; a first and second member extending from the valve stem, each member in fluid communication with the valve stem, wherein a plurality of bristles is disposed on an inner surface of each member; increasing the pressure within the hermetically sealable volume by engaging the pumping device; and releasing the fluid through the valve by engaging the valve, wherein the fluid flows through the valve stem, through the first and second members, and past the plurality of bristles disposed on an inner surface of each member, further comprising: providing a pedal operatively connected to the valve, wherein a user may depress the pedal and actuate the valve into an open position.

The Summary of the Invention is neither intended nor should it be construed as representing the full extent and scope of the present invention. Moreover, references made herein to "the present invention" or aspects thereof should be understood to mean certain embodiments of the present invention and should not be construed as limiting all embodiments to a particular description. The present invention is set forth in various levels of detail in the Summary of the Invention and in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken with the drawings.

BRIEF DESCRIPTION OF THE DRAWINGS

The accompanying drawings, which are incorporated in and constitute a part of the specification, illustrate embodiments of the invention and with the general description of the invention given above and the detailed description of the drawings given below, explain the principles of these inventions.

Figure 1:
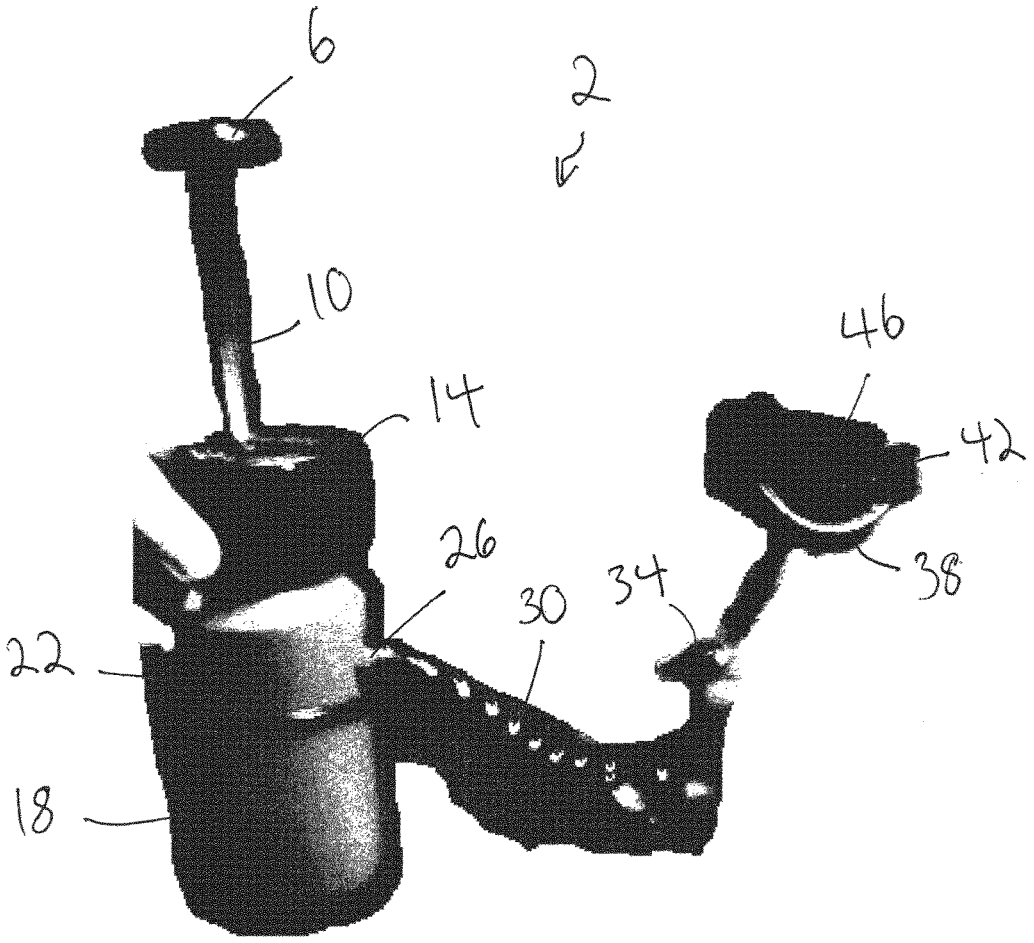
FIG. 1 is a front elevation view of a cleaning device according to one embodiment of the present invention.

To assist in the understanding of the embodiments of the present invention the following list of components and associated numbering found in the drawings is provided herein:

| No. | Component |
|---|---|
| 2 | Cleaning Device |
| 6 | Handle |
| 10 | Piston Rod |
| 14 | Cap |
| 18 | Container |
| 22 | Band |
| 26 | Container Outlet |
| 30 | Hose |
| 34 | Valve |
| 38 | Brush |
| 42 | Bristles |
| 46 | Brush Outlet |
| 50 | Second Container |
| 54 | Second Container Outlet |
| 58 | Entrained Fluid |
| 62 | Valve Stem |
| 66 | First Stem |
| 70 | Second Stem |
| 74 | First Bristles |
| 78 | Second Bristles |
| 82 | Radius |
| 86 | First Stem Angle |
| 90 | Third Stem |
| 94 | Third Bristles |
| 98 | Second Stem Angle |
| 102 | Third Stem Angle |
| 106 | First Member |
| 110 | Second Member |
| 114 | First Flexible Hose |
| 118 | Second Flexible Hose |
| 200 | Cleaning System |
| 204 | Bottle |
| 208 | Pump |
| 210 | Sprayer Assembly |
| 212 | Hose |
| 216 | Valve Button |
| 220 | Bottle Portion |
| 224 | Inner tube |
| 228 | Piston |
| 232 | Piston Head |
| 236 | Member |
| 240 | Inner Surface |
| 244 | Air Vents |
| 248 | Valve |
| 252 | Seal |
| 256 | Upper End |
| 260 | Cap |
| 264 | Fitting |
| 268 | Handle |
| 272 | Hose |
| 276 | Valve |
| 280 | Fitting |
| 284 | Member |

-continued

| No. | Component |
|---|---|
| 288 | Nozzle |
| 292 | Brush Holder |
| 296 | Bristles |
| 297 | Opening |
| 298 | Fluid |
| 300 | Cleaning System |
| 304 | Bottle |
| 308 | Brush |
| 310 | Cap |
| 312 | Valve |
| 316 | Golf Ball |
| 320 | Rigid Bottle |
| 324 | Sleeve |
| 328 | Pump Valve |
| 332 | Cover |
| 336 | Ridges |
| 340 | Scrapper |

It should be understood that the drawings are not necessarily to scale. In certain instances, details that are not necessary for an understanding of the invention or that render other details difficult to perceive may have been omitted. It should be understood that the invention is not necessarily limited to the particular embodiments illustrated herein.

DETAILED DESCRIPTION

As described below, various embodiments of the present invention include a cleaning device 2 that provides a pressurized fluid. Embodiments of the present invention have significant benefits across a broad spectrum of endeavors. It is the Applicant's intent that this specification and the claims to be accorded a breadth in keeping with the scope and spirit of the described invention or inventions despite what might appear to be limiting language imposed by referring to specific disclosed examples.

FIG. 1 shows an elevation view of a cleaning device 2 used to clean golf equipment. The primary housing for the fluid is the container 18, which in this particular embodiment is a generally cylindrical vessel with a top opening and a container outlet 26. A cap 14 is disposed over the top opening of the container 18 forms a hermetic seal with the container 18. In this embodiment, the cap 14 screws onto threads disposed on the outer surface of the container 18. One skilled in the art will appreciate that in other embodiments the cap 14 may snap onto the container 18, latch onto the container 18, be bolted or riveted onto the container 18, or connected to the container 18 using any fastening means described elsewhere herein or known in the art.

The container 18 depicted in FIG. 1 is generally cylindrical in shape, however, other embodiments may comprise a container 18 which is a different shape. For example, in one embodiment, the container is crescent shaped like a flask. In this embodiment the container may be more easily interfaced with curved surfaces such as the perimeter of a golf bag or a portion of a golf cart. The interface between the concave portion of the container and the curved or even non-curved surface provides a more stable interface.

In other embodiments, the container is a flexible material with an amorphous shape. Thus the container may be folded or compressed to fit into smaller enclosures such as the pocket of a golf bag or golf cart. The container may comprise of any material that provides a nonpermeable layer to the container. In some embodiments, a steel braided container provides a nonpermeable container that also may be flexible or non-rigid. In other embodiments, the container may comprise one or more polyethylene sheets surface by a nylon fabric such as 1000 Denier. In yet further embodiments, the container may comprise a fabric coated or dipped in rubber. One skilled in the art will appreciate a container that comprises many materials and combinations of materials to create a container that may pressurize a fluid and gas, yet retains a degree of flexibility.

In the embodiment depicted in FIG. 1, the cleaning device 2 is manually powered. Extending upward from the cap 14 is a piston rod 10 and a handle 6 disposed on the uppermost end of the piston rod 10. When a user wants to pressurize the fluid within the container 18, the user grasps the handle 6 and drives the piston rod 10 into the container 18, which pressurizes the fluid. After the drive motion, the user pulls the handle 6 and pulls the piston rod 10 out of the container 18. A one way valve or check valve remains hermetically sealed during the drive stroke but allows additional air to enter the container 18 during the pull stroke. Thus more and more air is added into the container 18 which creates a greater and greater pressure. One skilled in the art will appreciate other pumping devices known in the art and discussed elsewhere herein.

One skilled in the art will appreciate a variety of power alternatives. For example, in one embodiment of the present invention the cleaning device 2 is operatively connected to the power source that drives a golf cart. In other embodiments, the cleaning device 2 is pressurized via a foot pedal or hand pump. This configuration may be disposed on the passenger side of a golf cart, wherein the passenger may power the pedal on the floor of the golf cart to pressurize a cleaning device disposed in relative proximity to the golf cart. Some embodiments may also include an additional pedal or button or other similar means to release the pressure from the cleaning device 2 such that a user may clean a golf club, golf ball, or other object with accumulated dirt and debris.

The other opening of the container 18 is the container outlet 26, which in this embodiment is disposed on the outer, rounded surface of the container 18. Extending outward and laterally from the container 18 is a hose 30, which is coiled in this embodiment. At the end of the hose 30 is a valve 34 that provides a hermetic seal such that the pressurization that occurs in the container 18 does not leak out of the hose 30.

On the other side of the valve 34 is a brush 38, which comprises bristles 42 and a brush outlet 46. Once the user has achieved the desired fluid pressure within the container 18, he or she may engage the valve 34 and release the pressurized fluid through the hose 30 and out of the brush outlet 46 disposed on the brush 38. Between the bristles 42 extending outward from the brush 38 and the pressurized fluid ejecting from the brush outlet 46, the cleaning device 2 cleans any golf equipment and the small features that are commonly found on golf equipment.

Figure 2:
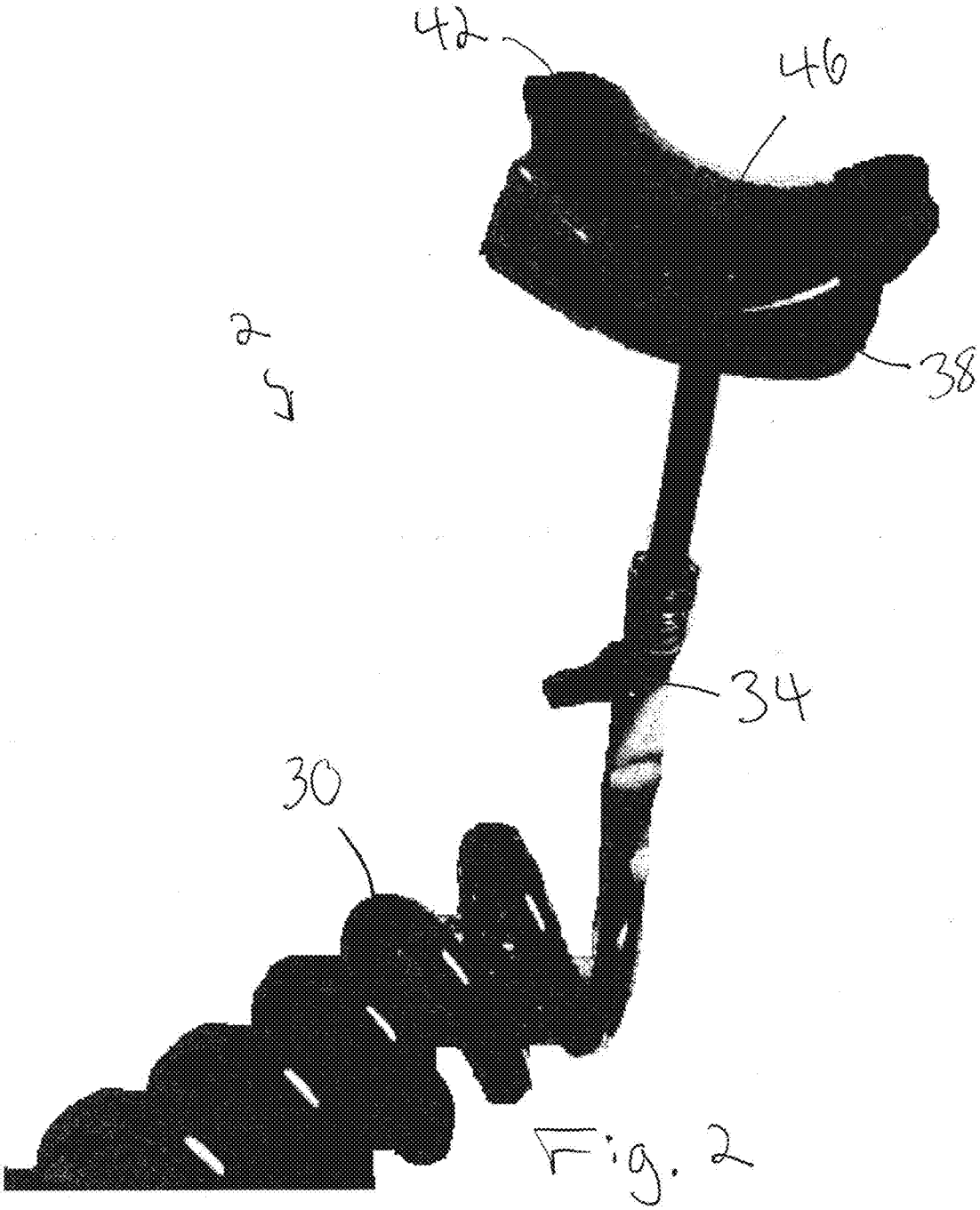
FIG. 2 is a detailed front elevation view of the brush and hose of the embodiment in FIG. 1.

Now referring to FIG. 2, a more detailed view of the brush 38 is provided. Here, the valve 34 is an inline valve that regulates fluid flow through a tubing configuration. In this embodiment, the valve 34 is regulating fluid flow between the hose 30 and the brush 38. The valve receives a stem portion of the brush 38 via an interference or friction fit. Likewise, the valve 34 receives the hose 30 via an interference or friction fit. One skilled in the art will appreciate that in other embodiments of the present invention the valve 34 may connect to the brush 38 or the hose 30 with a hose clamp, via a traditional threaded connection, with a latching configuration, or any other fastening means discussed elsewhere herein or commonly known in the art.

When the handle of the valve 34 is closed, e.g., perpendicular to the housing of the valve 34, the pressurized fluid is hermetically sealed within the container 18 and the hose 30. When a golfer wants to release the pressurized fluid, he or she opens the handle of the valve 34 such that the handle is substantially parallel with the housing of the valve 34. In this configuration, the valve 34 allows the pressurized fluid to flow into the brush 38 and out of the brush outlet 46. One skilled in the art will appreciate several locations for a valve 34, inline or otherwise. For example, a valve may be disposed at the container outlet 26 where the container 28 connects to the hose 30. Therefore, only the container 18 stores pressurized fluid before release instead of both the container 18 and the hose 30. If the hose 30 need not be designed to hold a pressurized fluid, then the hose 30 may be made to less expensive design specifications. This is only one example of an alternative location for a valve 34, and one skilled in the art will appreciate many more alternative locations.

Also shown in FIG. 2 is a detailed view of the brush 38, bristles 42, and brush outlet 46. In this embodiment, the brush 38 and the bristles 42 are configured to with a concave radius of curvature. In some embodiments the radius of curvature of the bristles 42 is between approximately 0.5 inches and 2.5 inches. In preferred embodiments, the radius of curvature of the bristles 42 is approximately greater than 0.5 inches. In a further preferred embodiment, the radius of curvature of the bristles 42 is between approximately 1.13 and 2.13 inches. In a most preferred embodiment, the radius of curvature of the bristles 42 is approximately 1.68 inches.

Further in the embodiment shown in FIG. 2, the radius of curvature exists only in one plane. In other words, the bristles 42 are curved only in the longitudinal dimension of the brush 38. In other embodiments, the bristles 42 may also be curved in a lateral dimension or any other dimension. In addition, the shape of the bristles 42 or the brush 38 is not limited to curved shapes. In some embodiments, the bristles 42 and the brush 38 may be substantially planar. In other embodiments, the bristles 42 and the brush 38 may form the shape of a rectangular prism, triangular prism, rectangular pyramid, triangular pyramid, cube, cylinder, code, sphere, trefoil, tetrafoil, pentafoil, etc. The shape of the bristles 42 and the brush 38 may also include amorphous shapes, fractal shapes, and/or disjointed, discretized, shapes. The shape of the bristles 42 may also differ from the shape of the brush. In one example, the bristles 42 are curved like those in FIG. 2, but the brush 38 is substantially planar such that the central bristles 42 are stiffer than the outer bristles 42. One skilled in the art will appreciate a variety of combinations of bristle 42 and brush 38 shapes and stiffnesses to suit a variety of needs.

In the embodiment depicted in FIG. 2, a brush outlet 46 is disposed in a central location on the end of the brush 38 and between the bristles 42. As the pressurized fluid exits the brush outlet 46, the pressurized fluid impinges upon a surface of the golf equipment needing cleaning. The impinging fluid creates an environment where the fluid splashes back onto the bristles 42 such that the bristles 42 help clean the golf equipment with the aid of the excess or spent fluid.

Figure 3:
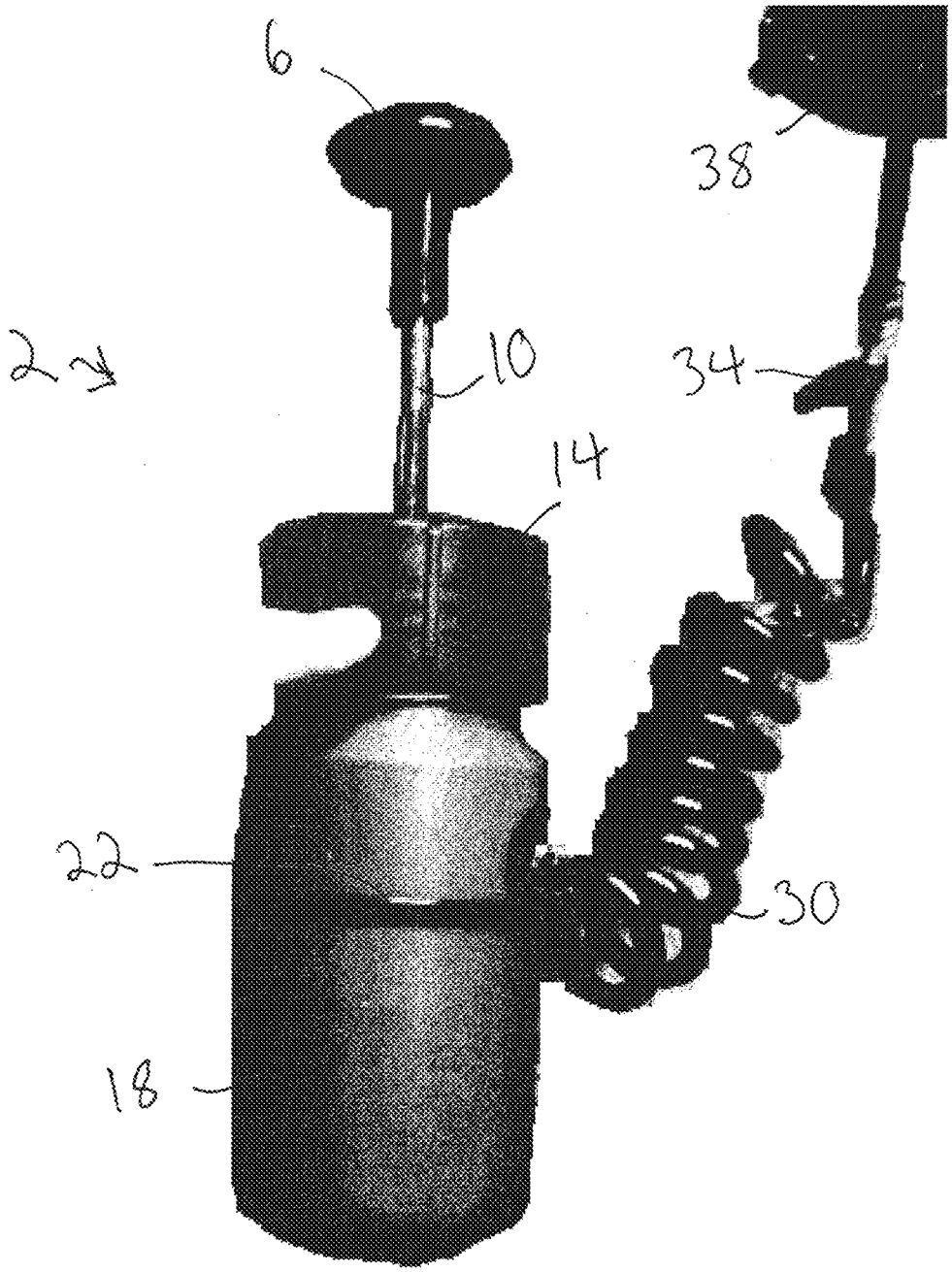
FIG. 3 is a detailed front elevation view of the container and piston rod of the embodiment in FIG. 1.

FIG. 3 shows an addition view of the cleaning device 2 wherein a handle 6 is disposed on top of a piston rod 10, and the piston rod 10 is disposed through a cap 14 of a container 18. A fluid may be disposed within said container 18 such that reciprocation of the handle 6 pressurizes the fluid. A brush 38, valve 34, and hose 30 are connected to a container outlet 26 of the container 18 such that a user may engage the valve 34 and allow the pressurized fluid to flow out of the brush 38.

Figure 4:
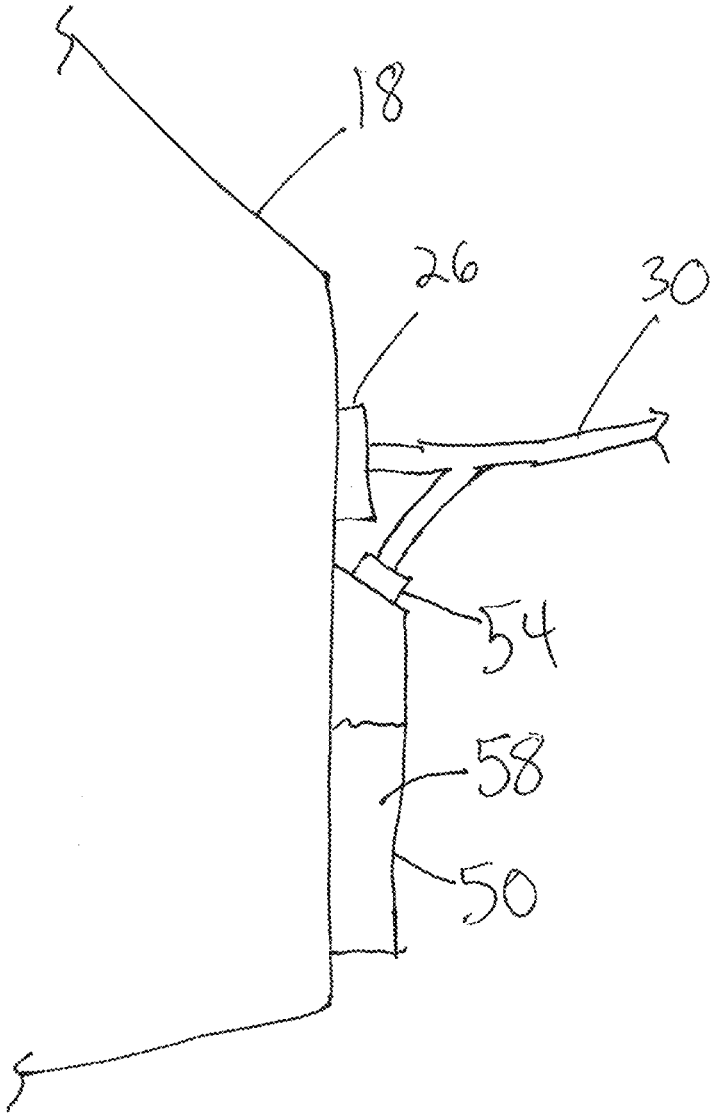
FIG. 4 is a side elevation view of a container that comprises a second container.

Now referring to FIG. 4, a side view of an embodiment of the present invention with a second container 50 is provided. In this particular embodiment, the second container is 50 affixed to the outer surface of the first container 18. A second container outlet 54 is disposed on the top surface of the second container 50. A tube running from the second container outlet 54 interconnects to the hose 30 that extends from the container outlet 26. Thus the second container 50 is in fluid communication with the hose 30. The contents of the second container 50 are depicted in FIG. 4, which in this embodiment is an entrained fluid 58.

As mentioned elsewhere herein, once the user has achieved the desired fluid pressure within the container 18, he or she may release the pressurized fluid out of the container 18 and through the hose 30. The relationship between movement of the fluid and the resulting pressure is shown by the Bernoulli equation:

$$P_1 + \frac{1}{2}\rho v_1^2 = \text{constant}$$

Where $P_1$ is pressure, $\rho$ is the density of the fluid, and $v_1$ is the velocity of the fluid. Thus, as the pressurized fluid flows through the hose 30, there is necessarily a decrease in pressure. The low pressure creates a pressure gradient between the hose 30 and the second container 50 such that the entrained fluid 58 rises and flows out of the second container outlet 54 and joins the pressurized fluid flowing through the hose 30.

The entrained fluid 58 may be a variety of fluids or even gases. In some embodiments, the fluid is a surfactant that lowers the surface tension between two liquids or between a liquid and a solid. Surfactants may act as detergents, wetting agents, emulsifiers, foaming agents, and/or dispersants. Surfactants may be further distinguished as anionic (e.g., soap), cationic (e.g., benzalkonium chloride, which is the active ingredient in Lysol), non-ionic (e.g., poloxamer, which is known by the trade name synperonics), and zwitterionic (e.g., cocamidopropyl hydroxysultaine, which is found in personal care products).

In the embodiment depicted in FIG. 4, the second container 50 is affixed to the side of the container 18. However, one skilled in the art will appreciate different configurations of the second container 50 and the container 18. For example, the second container 50 may be disposed within the container 18, and the second container outlet 54 may be selectively connected to the outer surface of the container 18 such that a user can unscrew the second container outlet 54 to refill the second container 50 with more entrained fluid 58. In yet another example, the second container 50 may be selectively interconnected to the outer surface of the container 18 such that a user may include or omit the second container 50 from the golf equipment cleaning device. In the instance where the user omits the second container 50, he or she may cap off a Y fitting on the hose 30 such that the pressurized fluid flows past the Y fitting and towards the brush outlet 46.

The second container 50 may comprise a variety of shapes. In some embodiments, the second container 50 has an annular shape and is concentrically disposed about the container 18. In yet further embodiments, two or more second containers 50 are disposed about the outer surface of the container 18. Thus the flow of pressurized fluid through the hose 30 may entrain fluid from more than one second container 50.

Figure 5A:
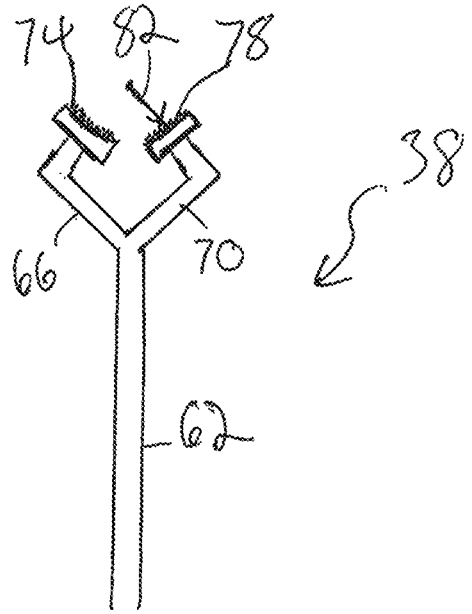
FIG. 5A is a side elevation view of an embodiment of a brush that comprises two stems and two pluralities of bristles.

Now referring to FIG. 5A, a side view of a brush 38 that has two stems is provided. In this embodiment, the brush 38 comprises a valve stem 62 connected to a valve 34 (shown in FIG. 1). The valve stem 62 splits into a first stem 66 and a second stem 70 at a downstream or distal end of the valve stem 62. The first and second stems 66, 70 may be the same tubular diameter as the valve stem 62. In other embodiments, the first and second stems 66, 70 may be a smaller or larger diameter to either speed or slow the flow of the pressurized fluid. Further, while the diameters of the first and second stems 66, 70 are identical in FIG. 5A, other embodiments of the present invention may comprise first and second stems 66, 70 with different diameters.

In the embodiment depicted in FIG. 5A, the pressurized fluid flows through the first and second stems 66, 70 before passing through a 90 degree turn and exiting past first bristles 74 and second bristles 78. The first and second stems 66, 70 are symmetric about a plane through a longitudinal axis of the valve stem 62, and the first and second bristles 74, 78 are oriented about a common radius 82, which in preferred embodiments corresponds to the radius of a golf ball or a thickness of a club head. In some embodiments the radius 82 is between approximately 0.5 inches and 2.5 inches. In preferred embodiments, the radius 82 is approximately greater than 0.5 inches. In a further preferred embodiment, the radius 82 is between approximately 1.13 and 2.13 inches. In a most preferred embodiment, the radius 82 is approximately 1.68 inches.

Figure 5B:
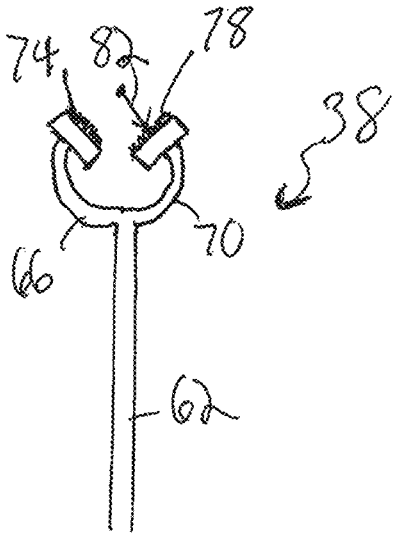
FIG. 5B is a side elevation view of an embodiment of a brush that comprises two stems and two pluralities of bristles.

Now referring to FIG. 5B, a brush 38 comprising first and second stems 66, 70 without 90 degree turns is illustrated. Rather, the first and second stems 66, 70 are continuously curved between their proximal end at the valve stem 62 and their distal end at the first and second bristles 74, 78, respectively. Similar to the brush 38 depicted in FIG. 5A, the first and second stems 66, 70 are symmetric about a plane through the longitudinal axis of the valve stem 62.

Figure 5C:
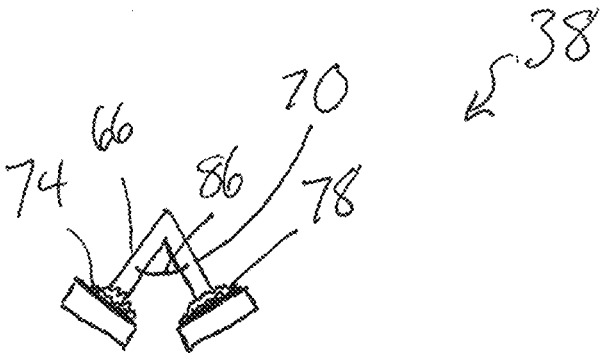
FIG. 5C is a top plan view of an embodiment of a brush that comprises two stems and two pluralities of bristles.

Now referring to FIG. 5C, a brush 39 comprising first and second stems 66, 70 is depicted in a top plan view. In this embodiment, the first and second stems 66, 70 are not symmetric about a plane through the longitudinal axis of the valve stem 62. Rather, the first and second stems 66, 70 and the corresponding first and second bristles 74, 78 are offset from one another by a first stem angle 86. This configuration of stems allows a user to concentrate pressurized fluid on one side of the dirty object such as a golf ball, which may have certain advantageous. In some embodiments, the first stem angle 86 is between approximately 170 degrees and 10 degrees. In other embodiments, the first stem angle 86 is less than approximately 180 degrees. In one embodiment, the first stem angle 86 is between approximately 110 degrees and 70 degrees. In one embodiment, the first stem angle 86 is approximately 90 degrees.

Figure 6A:
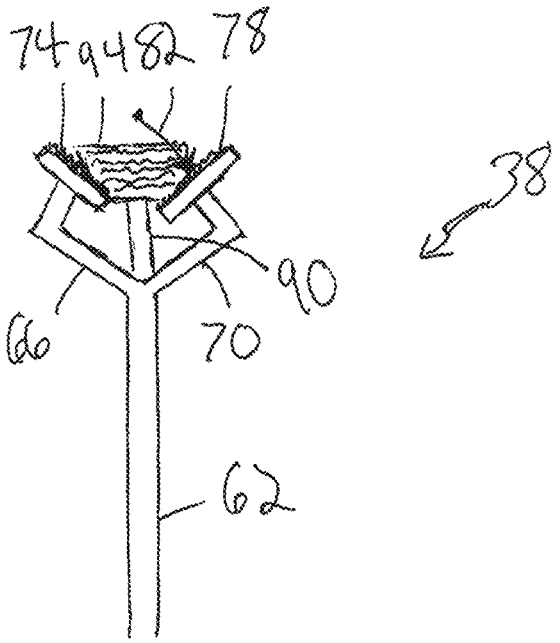
FIG. 6A is a side elevation view of an embodiment of the brush that comprises three stems and three pluralities of bristles.

Now referring to FIG. 6A, a brush 38 comprising first, second, and third stems 66, 70, 90 is illustrated in a side elevation view. Like the first and second stems 66, 90, the third stem 90 comprises a third set of bristles 94. In this embodiment, the three stems 66, 70, 90 are equally spaced about a longitudinal axis of the valve stem 62, and similar to the embodiment of FIG. 5A, the stems 66, 70, 90 include 90 degree turns. One skilled in the art will appreciate three-stem embodiments are not limited to 90 degree turn configurations. The embodiment depicted in FIG. 6A also includes the radius 82 where the bristles 74, 78, 94 are oriented about the radius 82, which in preferred embodiments corresponds to the radius of a golf ball.

Figure 6B:
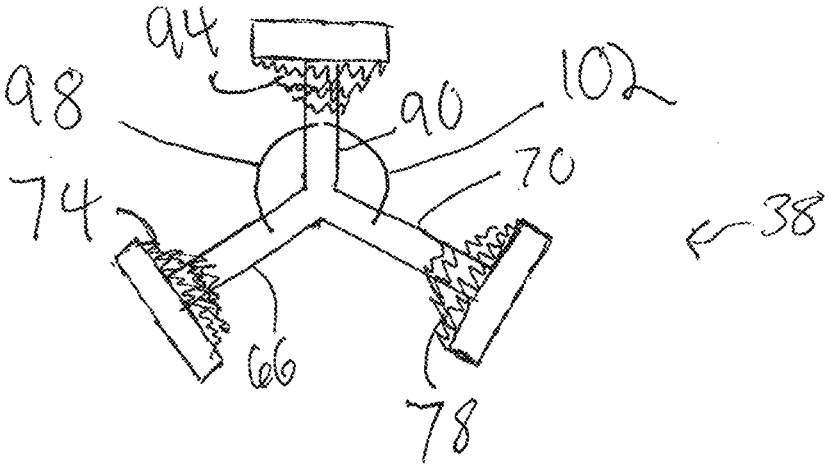
FIG. 6B is a top plan view of an embodiment of the brush that comprises three stems and three pluralities of bristles.

Now referring to FIG. 6B, a brush 38 comprising first, second, and third stems 66, 70, 90 is illustrated in a top plan view. The equal spacing between the stems, 66, 70, 90 is more clearly shown in FIG. 6B where the angle between the third stem 90 and the first stem 66 is the second stem angle 98, and the angle between the third stem 90 and the second stem 70 is the third stem angle 102. In some embodiments, the second stem angle 98 is between approximately 170 degrees and 10 degrees. In further embodiments, the second stem angle 98 is greater than 10 degrees. In more preferred embodiments, the second stem angle 98 is between approximately 80 degrees and 40 degrees. In a most preferred embodiment, the second stem angle 98 is approximately 60 degrees.

Similarly for the third stem angle 102, in some embodiments, the third stem angle 102 is between approximately 170 degrees and 10 degrees. In further embodiments, the third stem angle 102 is greater than 10 degrees. In more preferred embodiments, the third stem angle 102 is between approximately 80 degrees and 40 degrees. In a most preferred embodiment, the third stem angle 102 is approximately 60 degrees.

One skilled in the art will appreciate further embodiments of the present invention wherein more than three stems are utilized. In some embodiments, one or more stems interconnect to a continuous ring that comprises a bristled inner surface. Further yet, one skilled in the art will appreciate various combinations of stems and other components that may comprise a brush 38. For example, in some embodiments, the stem may not comprise an inner diameter for fluid to flow through. Instead, in some embodiments, the stem simply supports a bristled surface. Thus, for example, some embodiments of the present invention may comprise three stems where only one stem has an inner diameter for fluid to flow through. This may be advantageous to provide a more pressurized stem and bristle combination, where the other two stem and bristle combinations clear debris from the dirty object.

Figure 7A:
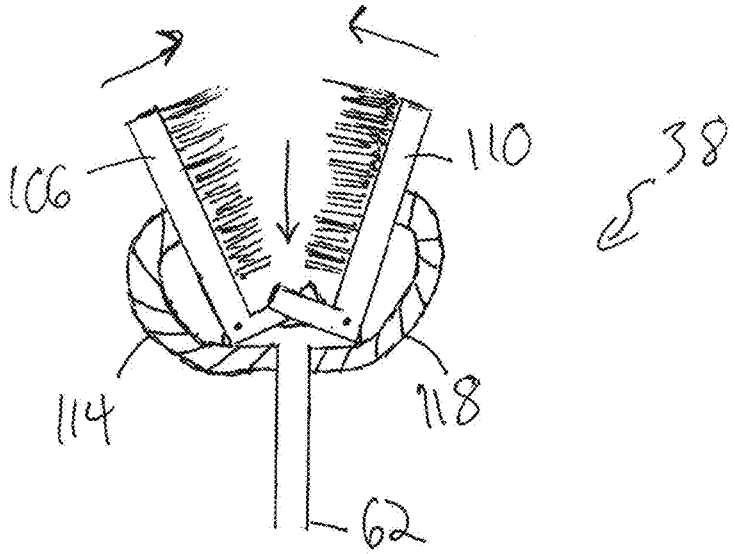
FIG. 7A is a side elevation view of an embodiment of the brush that comprises two members hingedly connected to a valve stem.

Now referring to FIG. 7A, a brush 38 comprising rotatable members is illustrated. A valve stem 62 extends from a valve 34 and terminates with a solid portion that comprises at least two protrusions on a distal end of the valve stem 62. These two protrusions comprise at least one aperture by which members may rotate about. A first member 106 is hingedly connected to one aperture, and a second member 110 is hingedly connected to another aperture. The first and second members 106, 110 are L-shaped with the longer side of the "L" extending outwardly and the shorter side of the "L" extending toward the opposite member. Each member 106, 110 has bristles disposed on an inner surface.

A first flexible hose 114 and a second flexible hose 118 extend from the valve stem 62, and each flexible hose 114, 118 is in fluid communication with the valve stem 62. The first flexible hose 114 extends to the back side of the first member 106 such that a pressurized fluid flows through the first flexible hose 114, through the first member 106, and past bristles disposed on the first member 106. Likewise, a second flexible hose 118 extends to the back side of the second member 110 such that a pressurized fluid flows through the second flexible hose 118, through the second member 110, and past bristles disposed on the second member 110.

The short side of the "L" shape of the members 106, 110 is configured to receive a dirty object. For example, as a golf club head is pressed downward into the short side of the "L" shape of the members 106, 110, the members 106, 110 rotate about their respect hinged connections to the valve stem 62 such that the bristles disposed on the members 106, 110 press into the side of the golf club head. Once the dirty object such as a golf club head is received in the bristles of the members 106, 110, then a user may operate the pumping device to pressurize fluid and dispense the same on the dirty object.

Figure 7B:
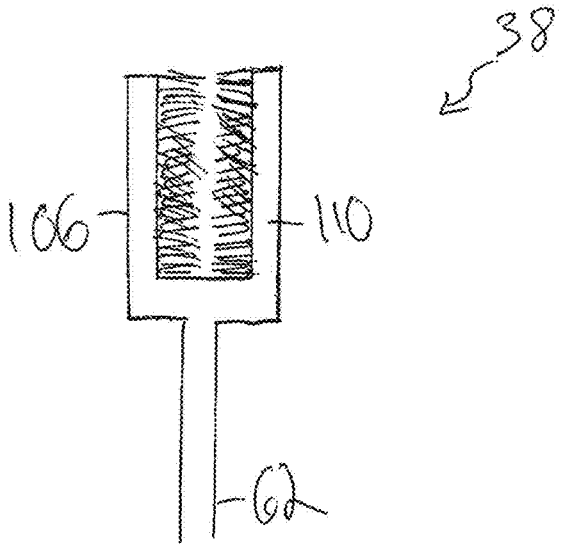
FIG. 7B is a side elevation view of an embodiment of the brush that comprises two members connected to a valve stem.
Figure 8:
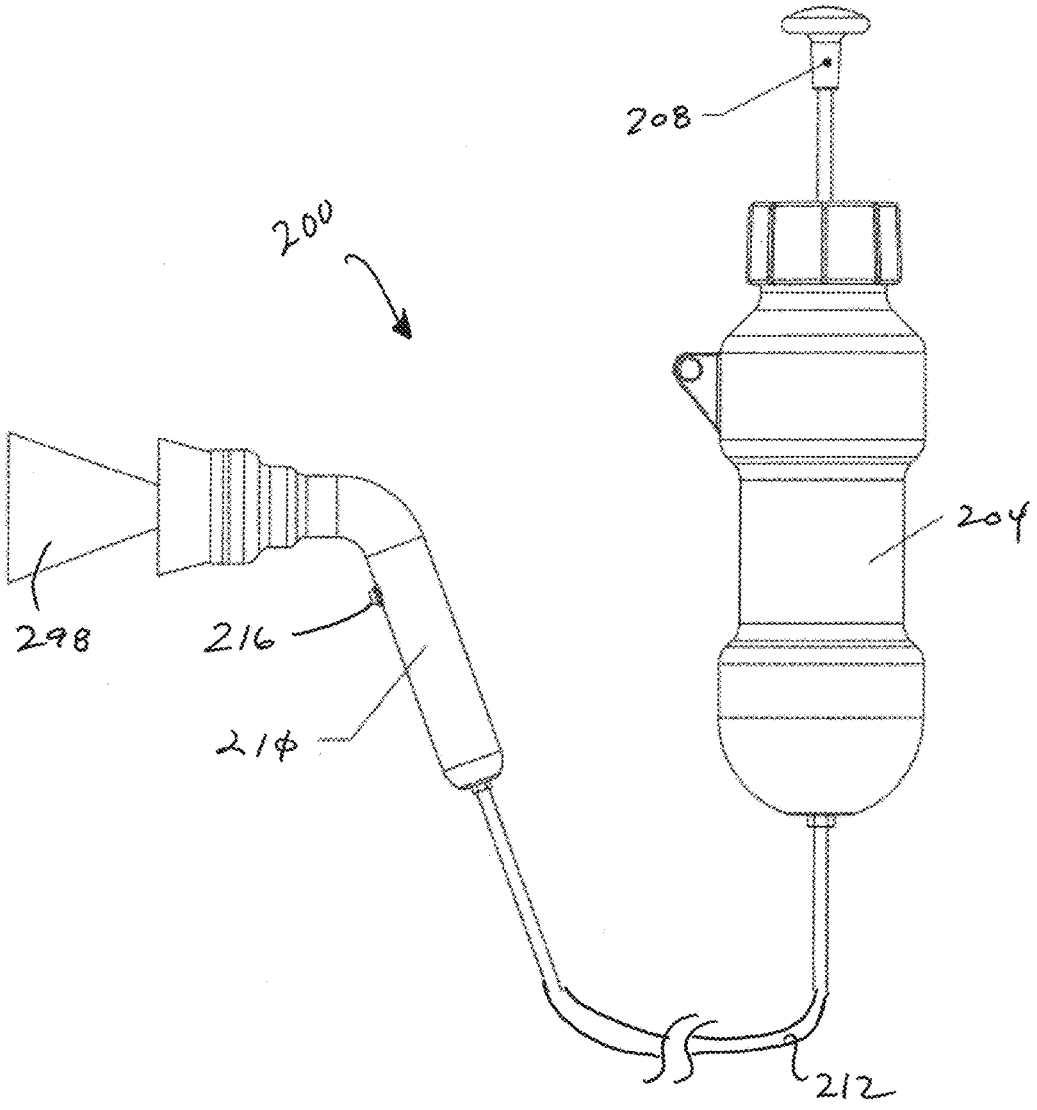
FIG. 8 is a front elevation of a cleaning system of another embodiment of the present invention.

Now referring to FIG. 7B, a brush 38 comprising fixed members is illustrated. In this embodiment, the fluid flow from the valve stem 62 is directly routed to a first member 106 and a second member 110. Bristles are disposed on the inward surfaces of both the first member 106 and the second member 110. The fluid routed through the first member 106 passes through the bristles disposed on the first member 106, and the fluid routed through the second member 110 passes through the bristles disposed on the second member 110. A dirty object may be pressed between the two fixed members 106, 110, and moved about while the user functions the pumping device and valve.

One skilled in the art will appreciate additional features that may enhance the ability of the cleaning device 2. For example, a heating element may be disposed about the valve stem 62 to heat the pressurized fluid as it passes through the valve stem 62. Heating the pressurized fluid will cause the fluid to expand and further increase the speed at which the fluid impinges upon the dirty object. Further, the heated fluid will have a steamer effect on the surface of the dirty object which helps loosed debris.

In another embodiment, the cleaning device comprises a pedal-actuated valve 34. Pedals are known in the art, and the depression of a pedal may actuate the valve 34 into an open position. This may be achieved by a cable operatively connected to both the pedal and the valve. When the user depresses the pedal, the cable is pulled towards the pedal, which pulls the cable away from the valve. The cable actuates the valve, placing the valve in an open position. One skilled in the art will appreciate other means to operatively connect a pedal or other device to a valve. In this additional feature, the user has a free hand to manipulate the brush and/or the object to be cleaned. Further, embodiments of the present invention may comprise a stand for the brush 38. In this configuration, the user does not use his or her hands to manipulate the brush 38 since the stand fixes the brush. Now the user may use his or her hands to manipulate the object to be cleaned.

In a further embodiment, the cleaning device 2 comprises a handle for the brush 38. A handle may be disposed about several location of the cleaning device 2. For example, a handle may be disposed about a stem portion of the brush 38. The handle provides a more secure location to grip the brush and the user is not affecting the structure integrity of the stem of the brush 38. Further yet, the valve between the hose 30 and the brush 38 may be disposed with the handle, and a button or trigger may extend through a portion of the handle such that a user may actuate the valve while gripping the handle.

In yet a further embodiment, the embodiments described herein to clean golf clubs may be combined with embodiments described herein to clean golf balls. For example, a splitter device may be affixed to the end of the hose 30 such that any number and combination of brushes 38 may be used together on the same cleaning device 2. This feature may be useful for golfing tournaments where many golfers may need to clean their equipment at the same time, and the feature may also be useful for an individual who wants ready access to both a golf club brush 38 and a golf ball brush 38.

FIGS. 8-13 show another cleaning system 200 that employs some or all of the features of the embodiments described above. Here, a washer bottle 204 is provided that is pressurized by manual pump 208. The water bottle 204 is interconnected to a sprayer assembly 210 by way of a flexible hose 212. In operation, the bottle 204 is pressurized with the manual pump 210 and water or cleaning fluid is selectively expelled through the sprayer assembly 210 when a spray valve button 216 is depressed.

Figure 9:
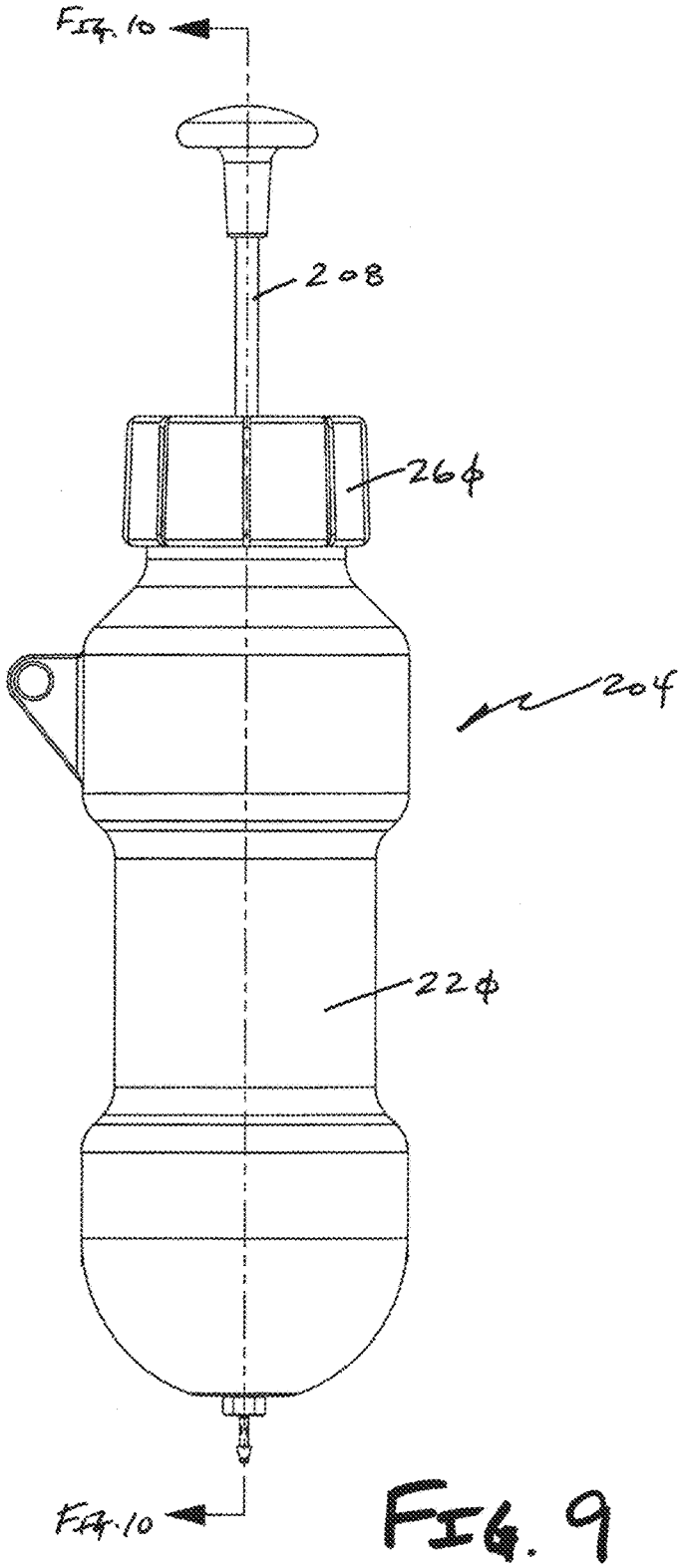
FIG. 9 is a front elevation view of a washer bottle used in the system of FIG. 8.
Figure 10:
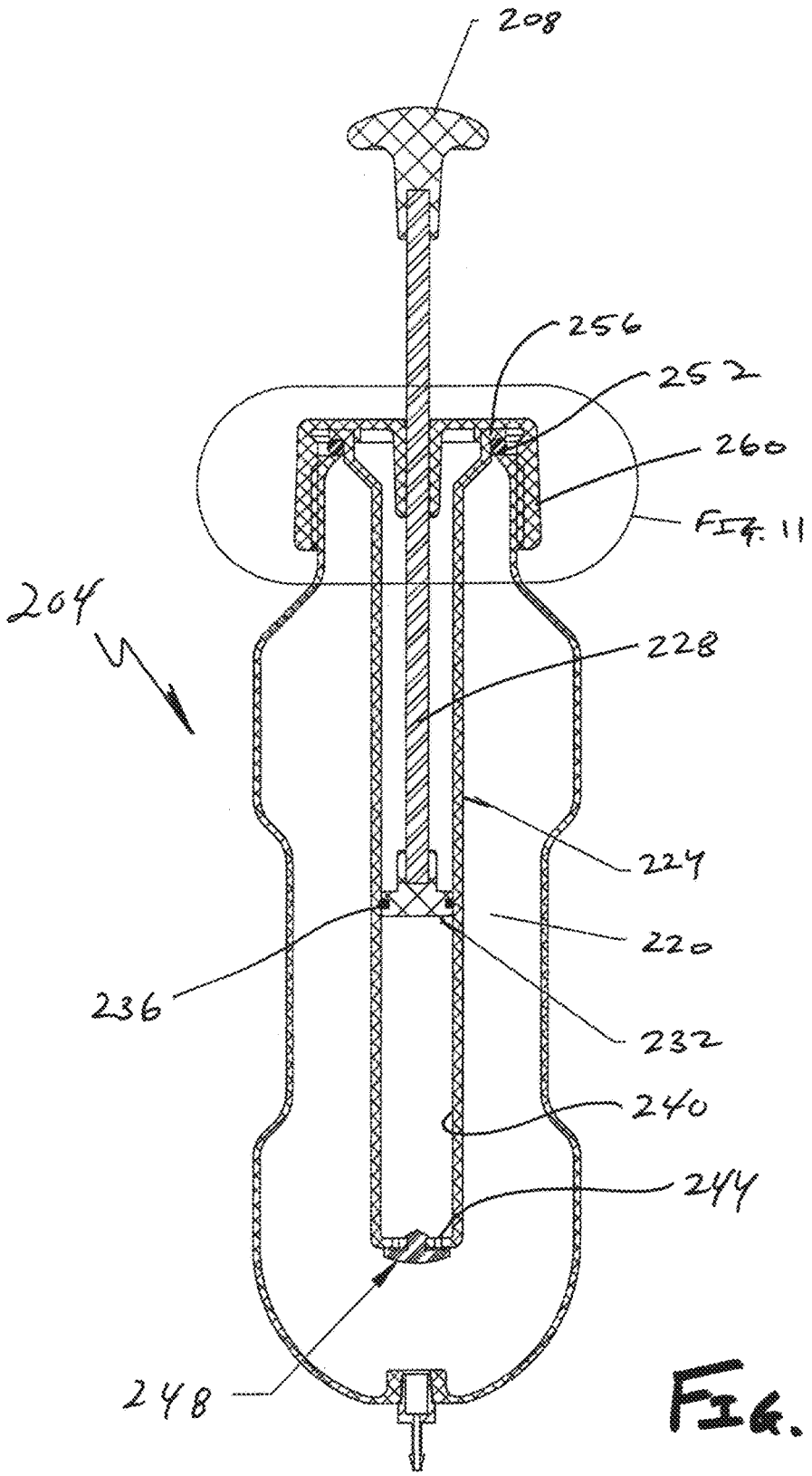
FIG. 10 is a cross-sectional view of FIG. 9.
Figure 11:
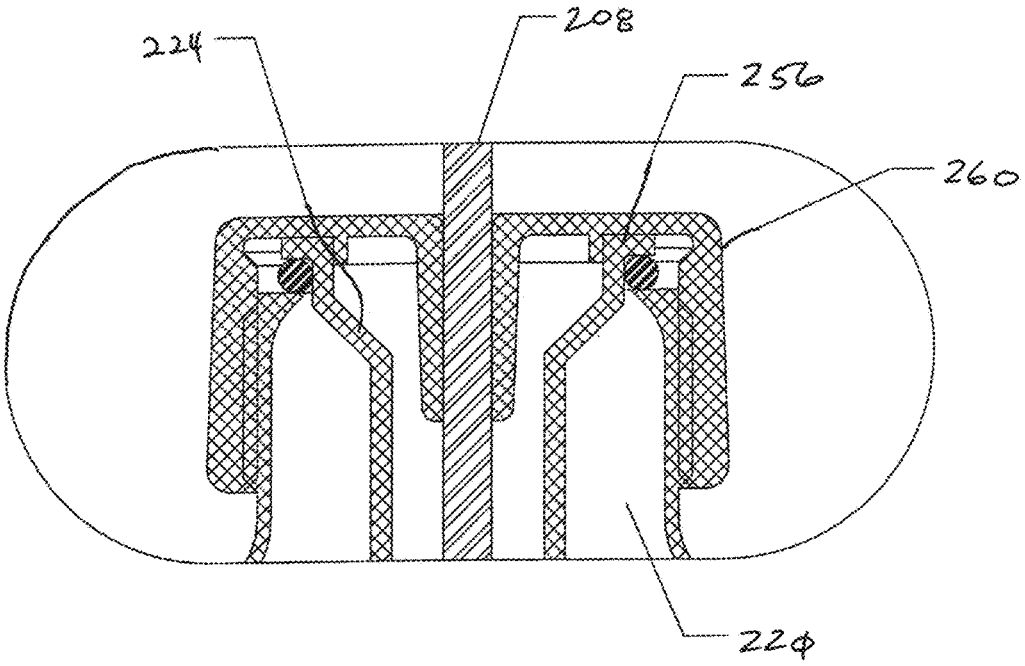
FIG. 11 is a detailed view of FIG. 10.

FIGS. 9-11 show the washer bottle 204 of one embodiment of the present invention. The washer bottle 204 includes a bottle portion 220 for storing water or cleaning fluid. An inner tube 224 is positioned within the bottle portion 220 and is adapted to operatively receive a piston 228. The piston 228 terminates at a piston head 232 that includes sealing member 236 that interfaces with the inner surface 240 of the inner tube 224. The inner tube 224 includes air vents 244 selectively blocked by a valve 248. The inner tube 224 is interconnected to the bottle portion 220 via a seal 252 that forms hermetically sealed system. More specifically, an upper end 256 of the inner tube 224 is in contact with a cap 260 that is threadingly engaged onto the bottle portion 220, which will be described in further detail below.

Referring now specifically to FIG. 11, an upper portion of the water bottle has threads that receive the cap 260. The cap 260 is designed to interface with threads of the bottle portion 220 to seal the same. However, the piston 228 associated with the pump penetrates the cap 260. Areas exterior to the inner tube 224 are hermetically sealed but the inner tube 224 can receive outside air used to pressurize the bottle portion.

In operation, the pump 208 is driven downwardly such that the piston head 232 moves closer to the end of the inner tube 224. Air trapped within the inner tube 224 is pressurized and can escape the air vents 244 positioned at the end of the inner tube 224. The pressure with the inner tube must overcome the resistance provided by the valve 248 positioned at the end of the inner tube 224. In this embodiment, the valve 248 is an umbrella valve that selectively deforms when the pressure within the inner tube 224 increases above a predetermined level. After the pressurized air escapes the inner tube 224, the interior volume of the bottle portion 220 is pressurized and, thus, is able to pressurize fluid in the flexible hose 212. Upon depression of the spray valve button 216, pressurized fluid escapes the sprayer assembly 210, similar to that described above. As the piston head 232 is pulled away from the bottle portion 220, the piston head 232 will move away from the end of the inner tube 224, thereby reducing the pressure and allowing the valve 248 to close. Cycling of the pump 208 pressurizes the bottle portion 220 or helps maintain the pressure within the bottle portion 220.

Figure 12:
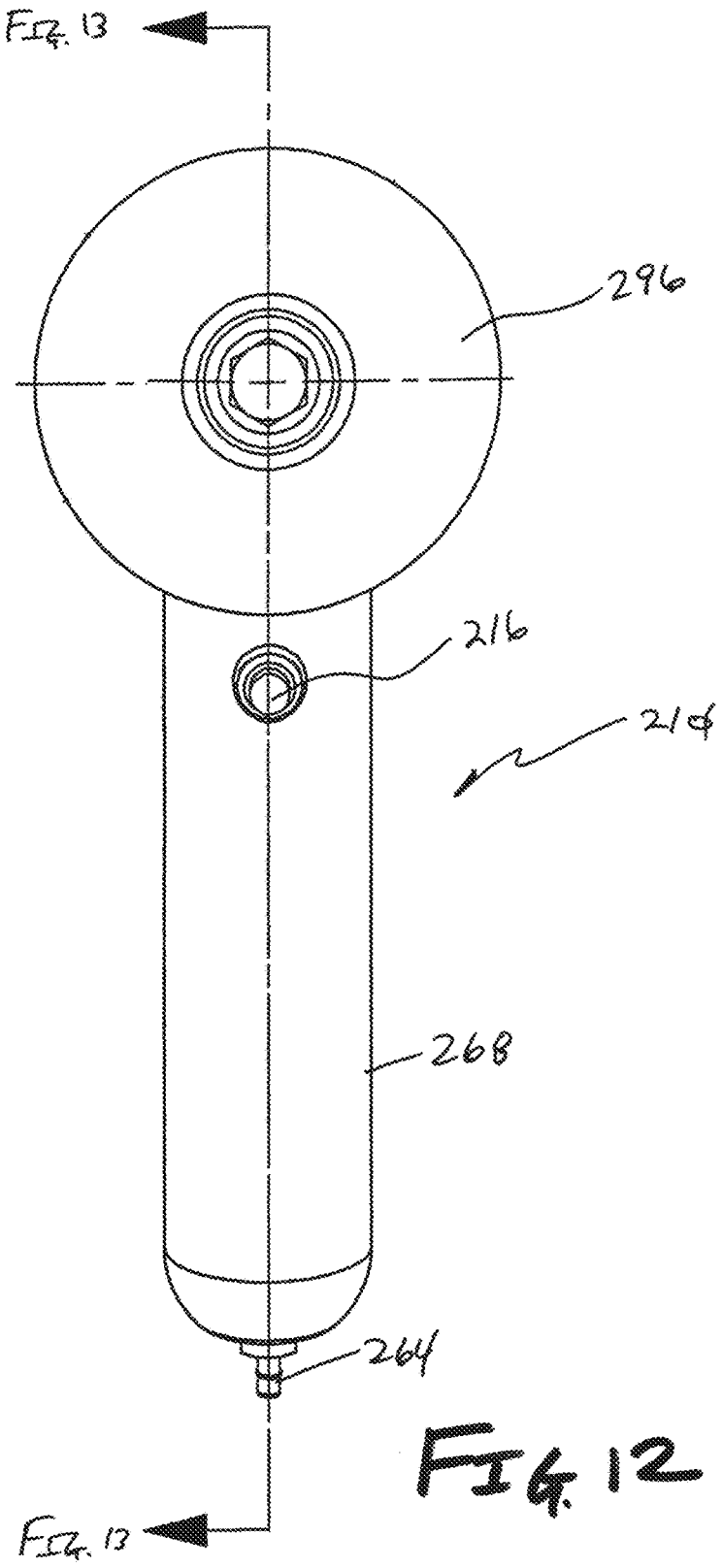
FIG. 12 is a side elevation view of a brush assembly employed by the system of FIG. 8.
Figure 13:
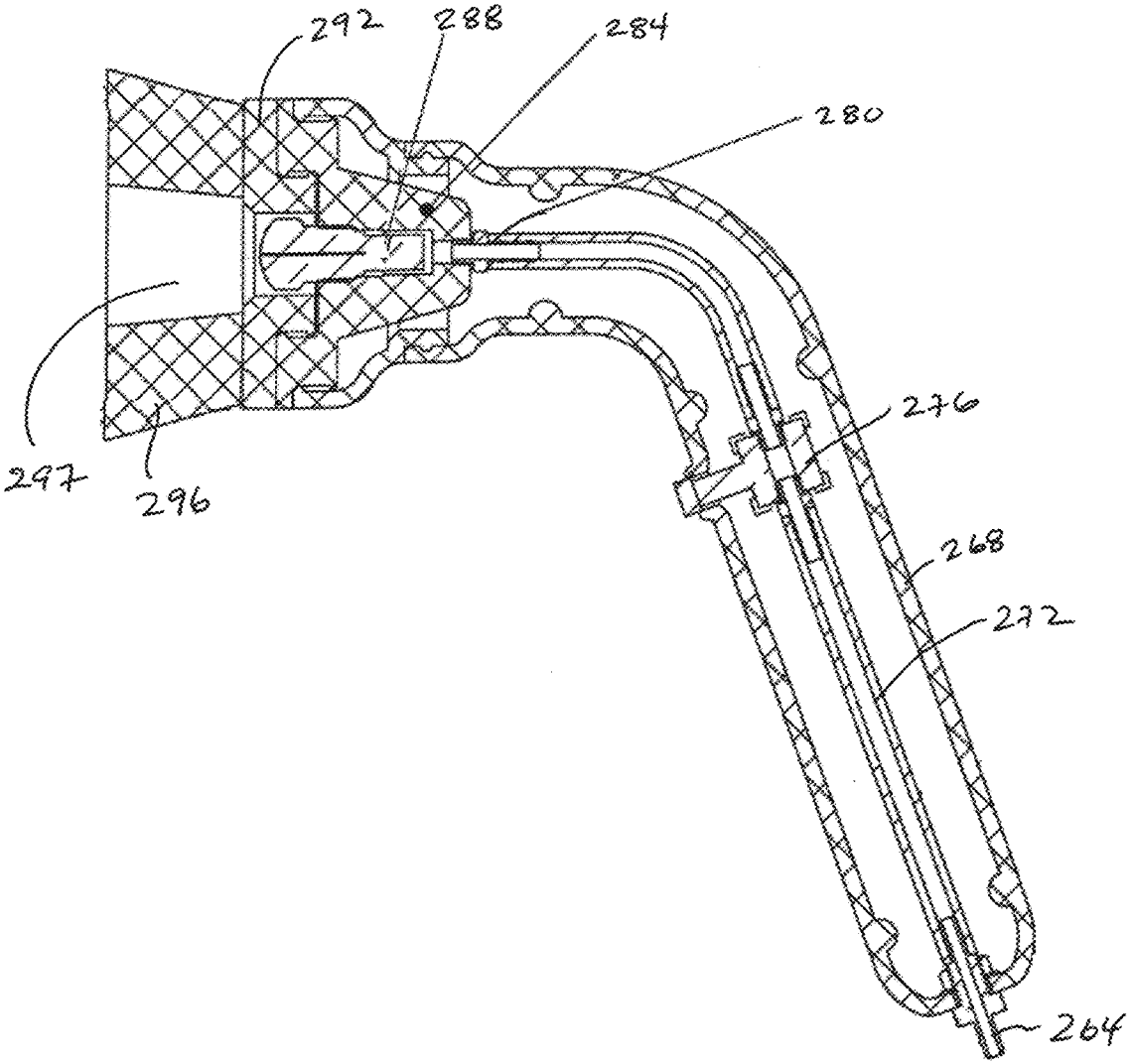
FIG. 13 is a cross-sectional view of FIG. 12.

FIGS. 12 and 13 show the sprayer assembly 210 of one embodiment of the present invention. The sprayer assembly 210 has a fitting 264 adapted for interconnection to the hose. This fitting is similar to a fitting provided on the water bottle shown in FIGS. 9 and 10. The fitting 264 is interconnected to a handle 268 that provides an ergonomic gripping surface. A hose 272, which is associated with a valve 276, delivers fluid from hose 212. The valve 272 is selectively actuated by the valve button 216. A second fitting 280 is provided that is interconnected to an inner member 284 that secures a spray nozzle 288. One of ordinary skill in the art will appreciate that the nozzle 288 may be selectively adjustable such that the amount and nature of spray exiting the sprayer assembly 210 can be altered. Finally, a brush holder 292 and associated bristles 296 are provided that includes an opening 297 that accommodates fluid 298 exiting the spray nozzle 288.

In operation, when the fluid within the system is pressurized, the valve button 216 is depressed, which opens the valve 276 positioned within the handle 268, and allows pressurized fluid to communicate with the spray nozzle 288. Fluid 298 is then projected through the bristles 296 and onto the surface to be cleaned. One of ordinary skill in the art will appreciate that although one nozzle 288 and brush holder 292 is provided, the concept provided above with respect FIGS. 5-7 may be incorporated onto the handle 268.

Figure 14:
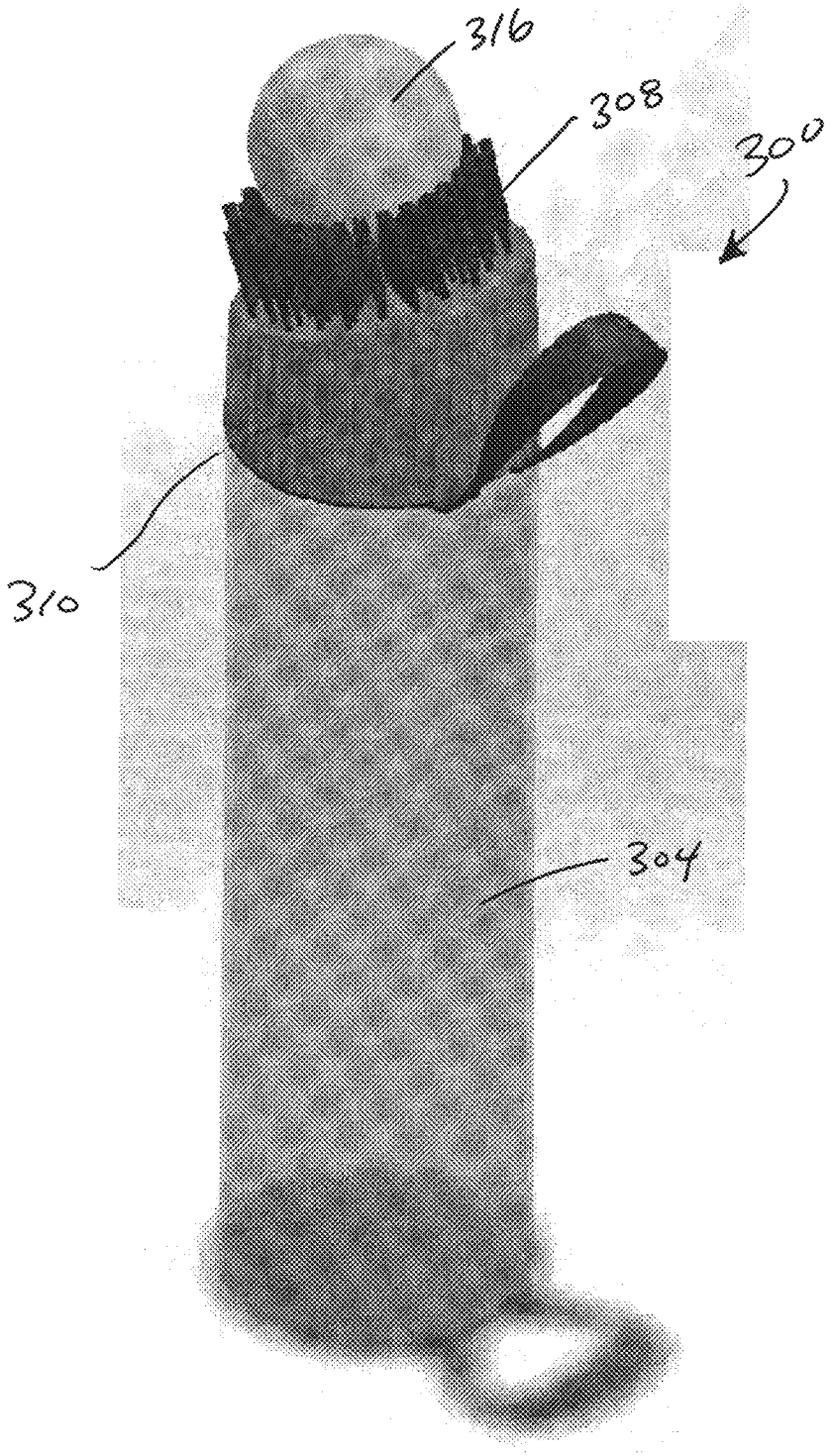
FIG. 14 is a perspective view of another embodiment of the present invention that utilizes a squeezable bottle.
Figure 15:
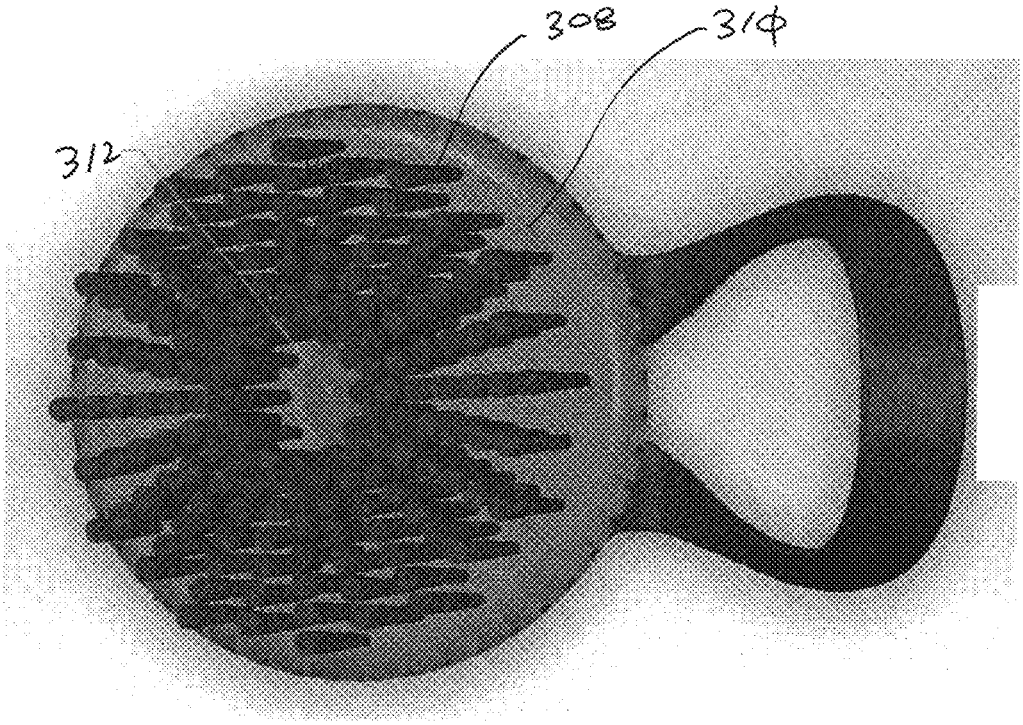
FIG. 15 is a top plan view of the embodiment shown in FIG. 14.

FIGS. 14 and 15 show another embodiment of a cleaning system 300 that employs a squeezable bottle 304, so a pump is not required. The squeezable bottle 304 holds water, cleaning fluid, or a combination thereof. The squeeze bottle 304 is sealed with a cap 308 that opens when the water or cleaning fluid is pressurized by squeezing the bottle. The water bottle may employ a lanyard so it can be secured to a golfer's bag or a golf cart.

In operation, a golf ball 316 or other golf related item, such as a club head, is placed in contact with the brush 308 and the bottle 304 is squeezed, which pressurizes the fluid within the bottle 304 to open the valve 312 to wet the item being cleaned or the brush 308.

Figure 16:
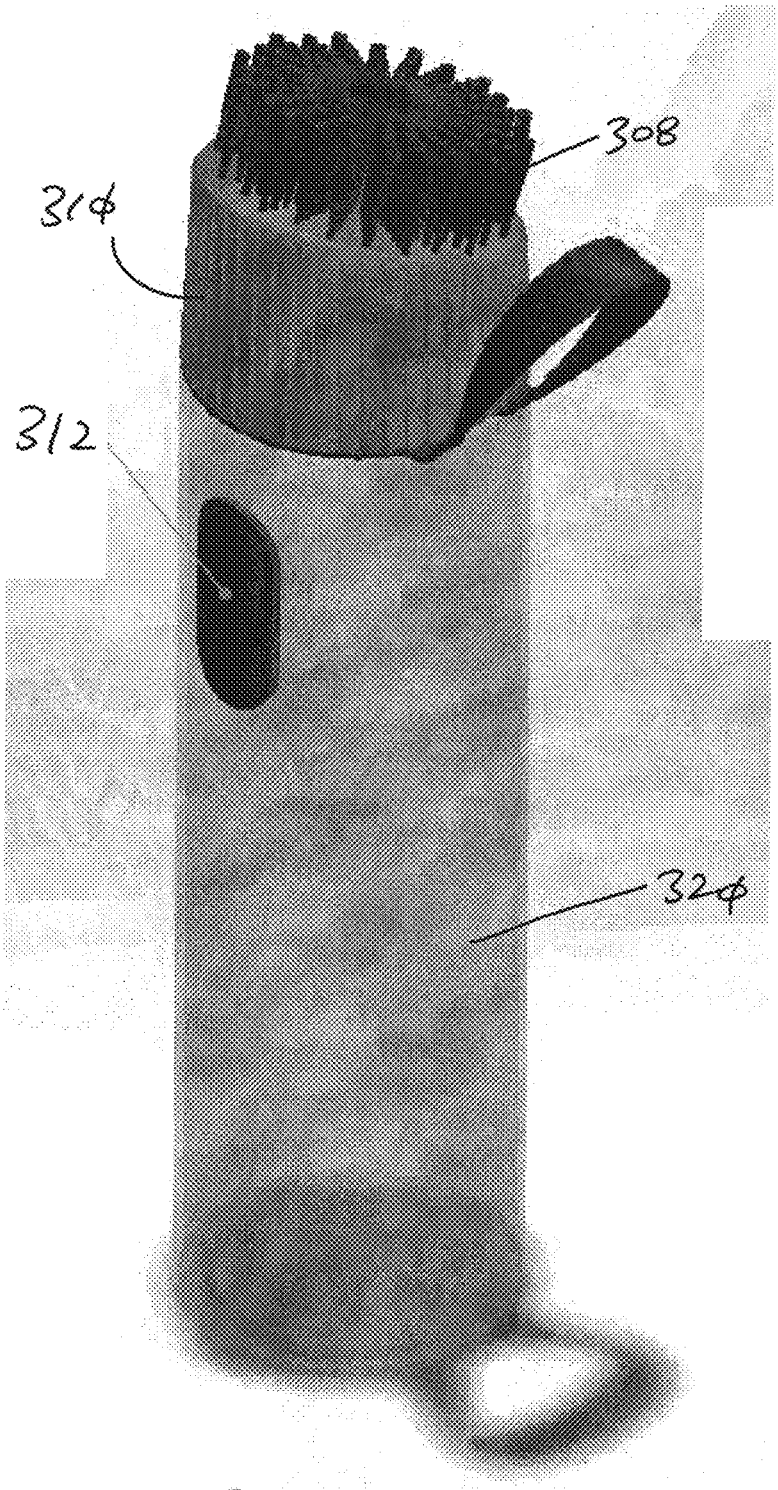
FIG. 16 is a perspective view of another embodiment of the present invention that includes a pump valve interconnected to a rigid bottle.
Figure 17:
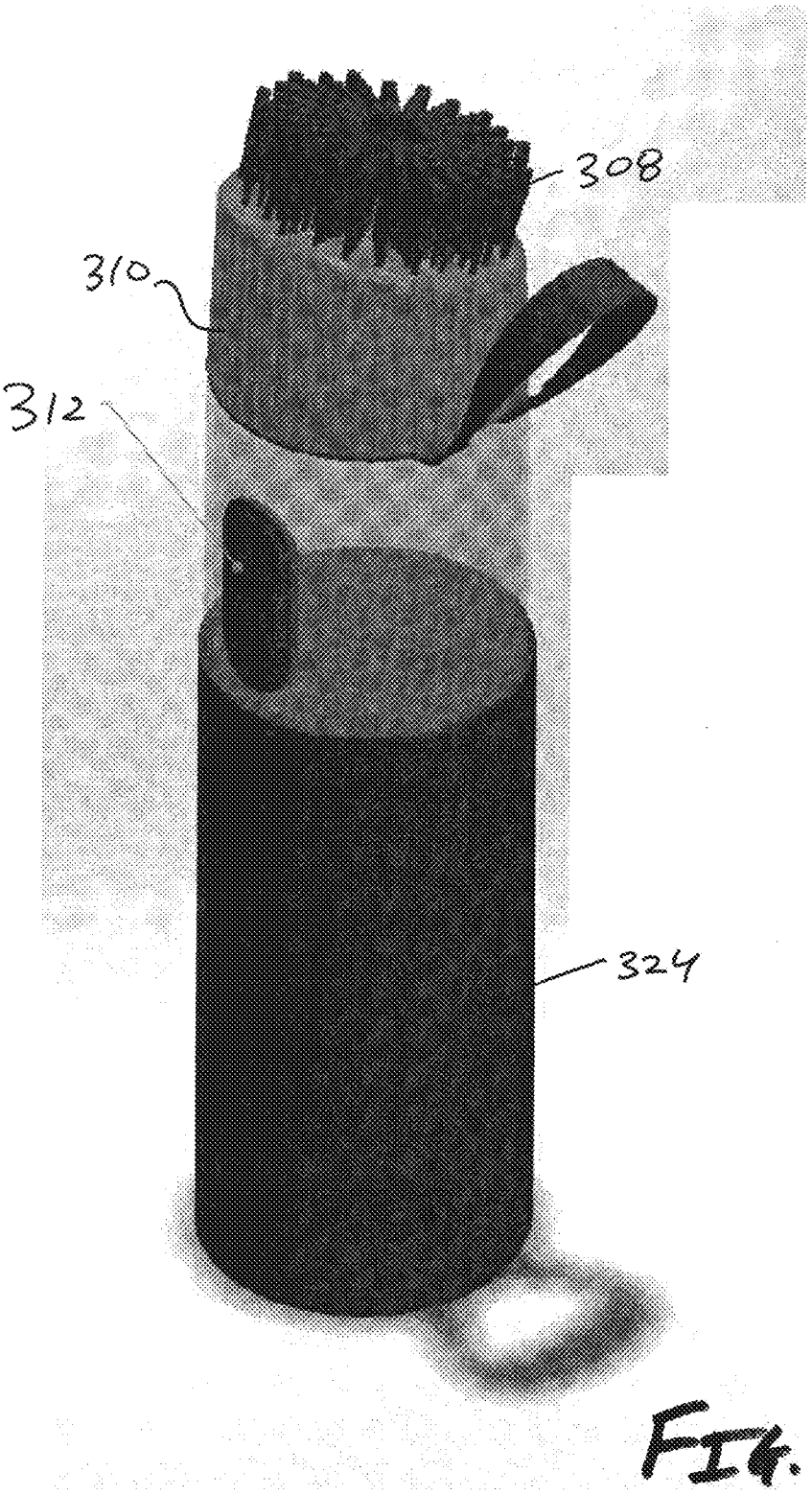
FIG. 17 is a perspective view of an embodiment similar to that shown in FIG. 16 that employs a sleeve.

FIGS. 16 and 17 show another embodiment similar to the embodiment of FIGS. 14 and 15. Here, however, a rigid bottle 320 is employed, which may be associated with a soft sleeve 324 that enhances gripping. A pump valve 328 is associated with an outer surface of the rigid bottle 320. The pump valve 328 can be interconnected to a hand pump and flexible hose as described in the embodiments disclosed above, or interconnected to other manual, hydraulic, or pneumatic pumps generally known in the art. The pump, regardless of its type or manufacture, allows the fluid within the rigid bottle 320 to be pressurized. That is, similar to the operation of the embodiments described above, this embodiment allows the user to selectively operate the pump valve 328 to pressurize the fluid within the rigid bottle 320. Fluid pressurization will open a valve 312 and expel fluid at a high pressure through the cap 310 and around the brush 308.

Figure 18:
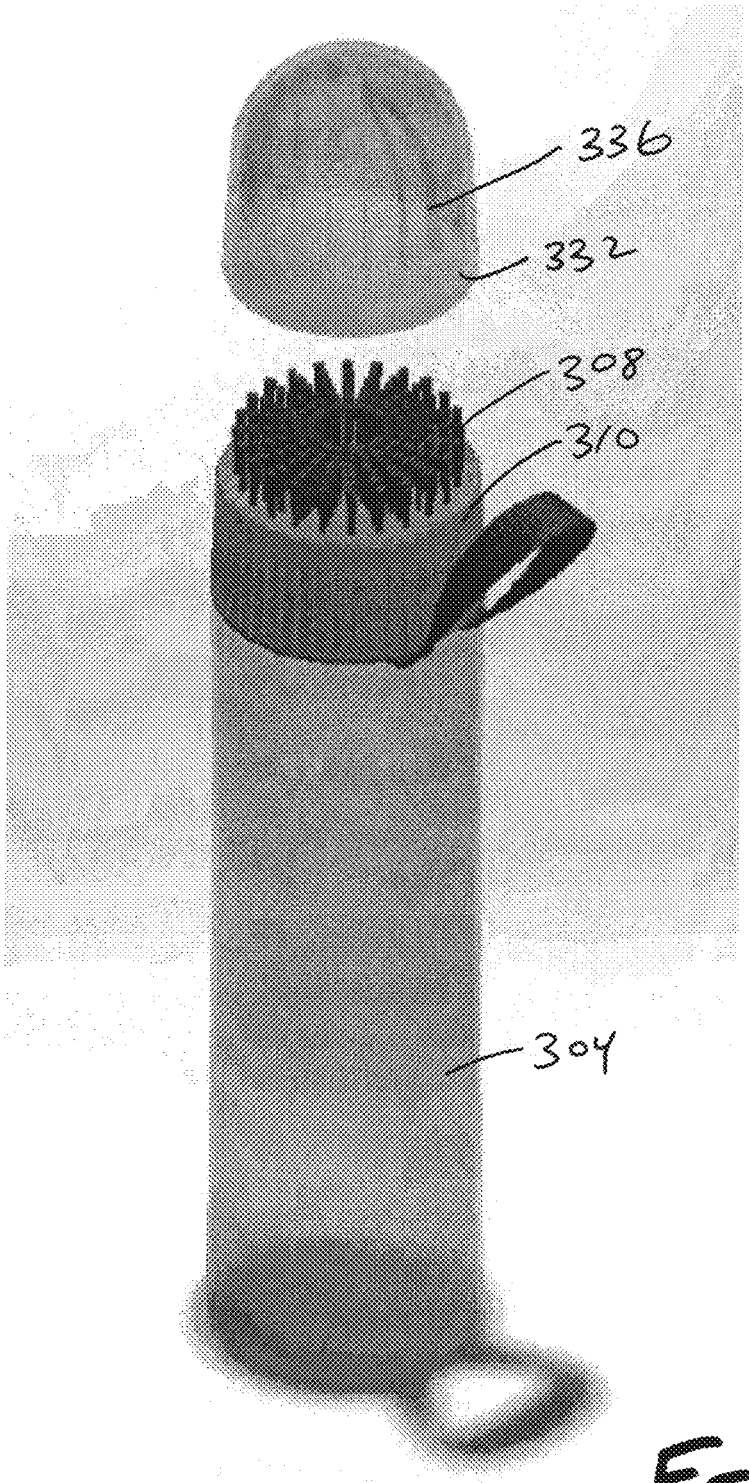
FIG. 18 is a perspective view of another embodiment of the present invention that employs a squeezable bottle adapted to clean a golf ball.
Figure 19:
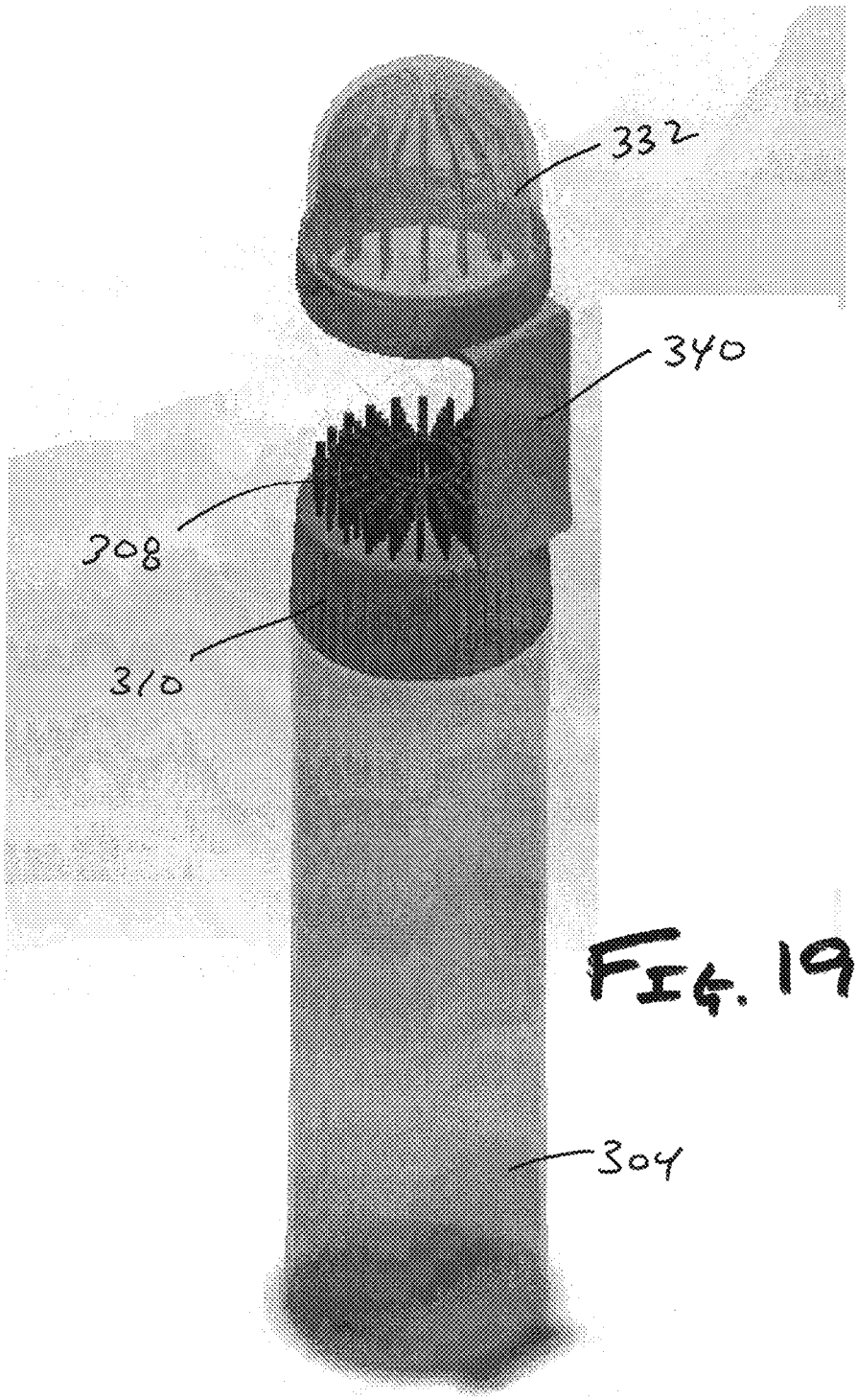
FIG. 19 is a perspective view of an embodiment similar to that shown in FIG. 18 that includes a scraper.
Figure 20:
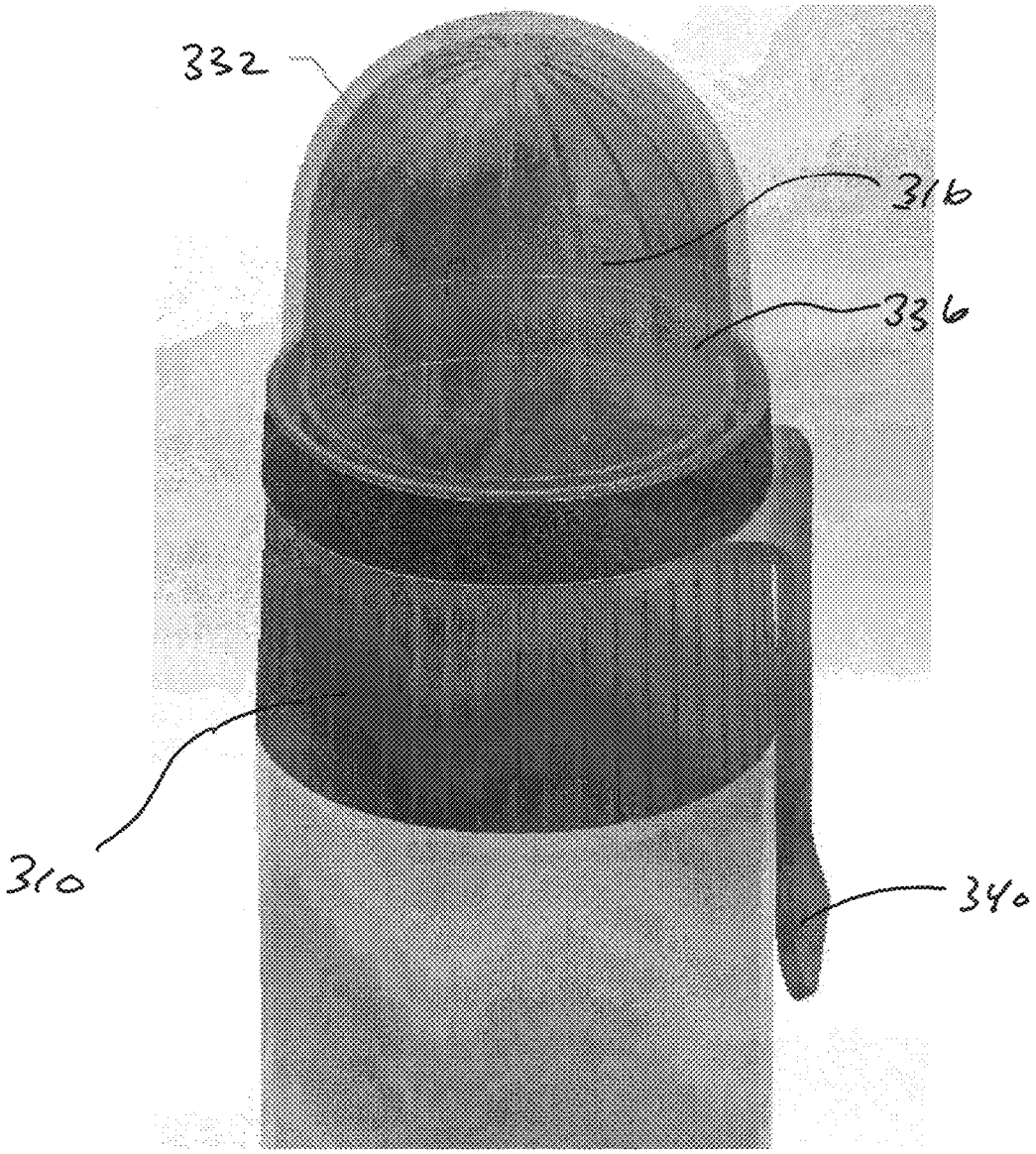
FIG. 20 is a detailed view of FIG. 19.

FIGS. 18-20 show yet another embodiment of the present invention that includes a cover 332 selectively interconnected over the cap 310. Here, the bottle can be rigid or squeezable, but in this example, the bottle 304 is squeezable. Thus this cleaning system operates similar to that of the embodiment shown in FIGS. 14 and 15. The cover 332 may have a plurality of ridges 336 extending from an inner surface thereof. As shown in FIG. 20 the ridges 336 help secure the golf ball 316 in a predetermined location such that when pressurized fluid exits the cap 310, the golf ball is washed effectively.

As shown in FIGS. 19 and 20, the cover 332 may also include a scraper 340 extending therefrom. The scraper 340 is used to remove large debris from a club head, for example. The scraper 340 may terminate at a point such that it can clean cleats or club head grooves. Furthermore, the scraper 340 may include a plurality of bristles (not shown) extending therefrom to provide yet another means to clean items wherein the user would hold the bottle 304 and use it as a brush handle.

Figure 21:
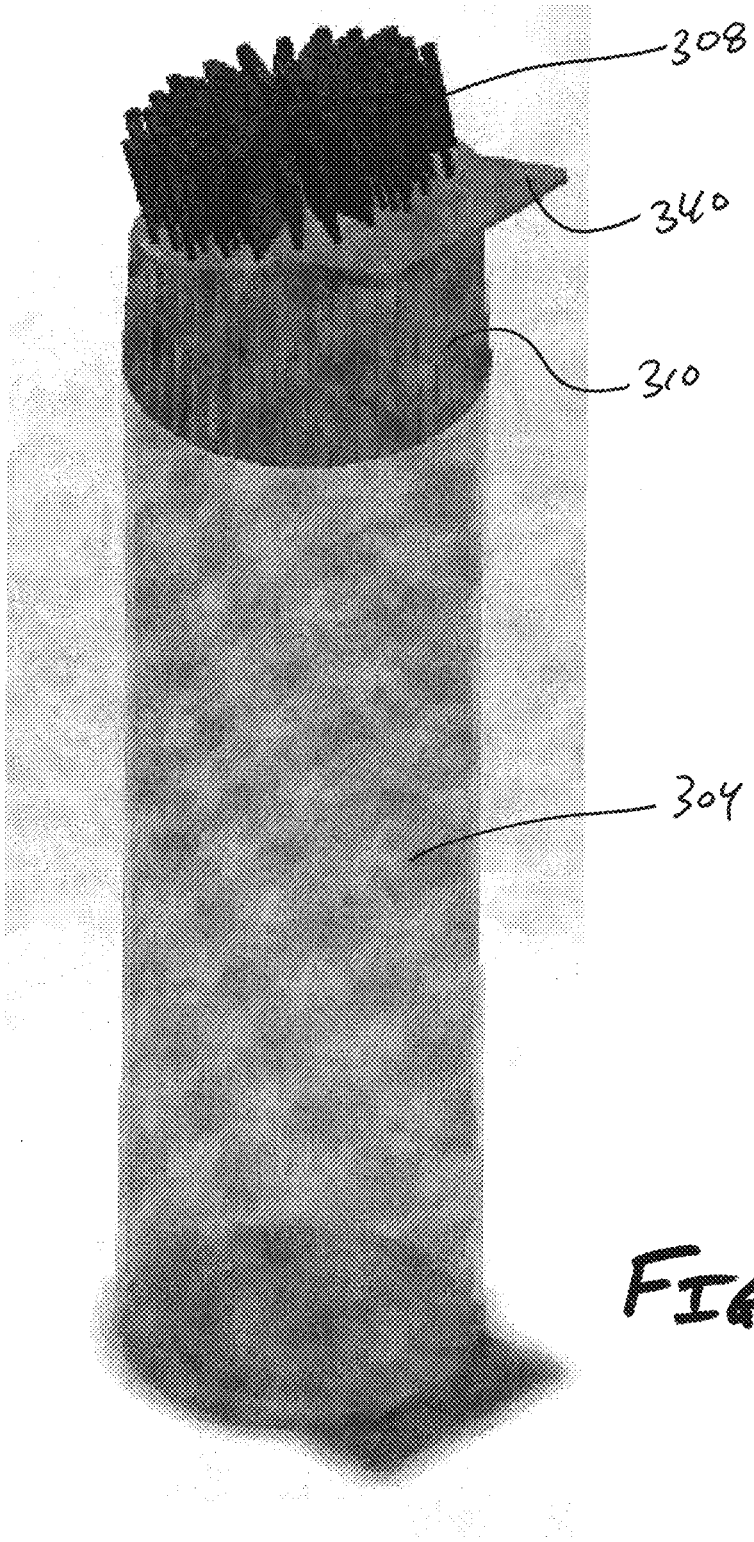
FIG. 21 is a perspective view of yet another embodiment of the present invention that has a cap with the scraper.
Figure 22:
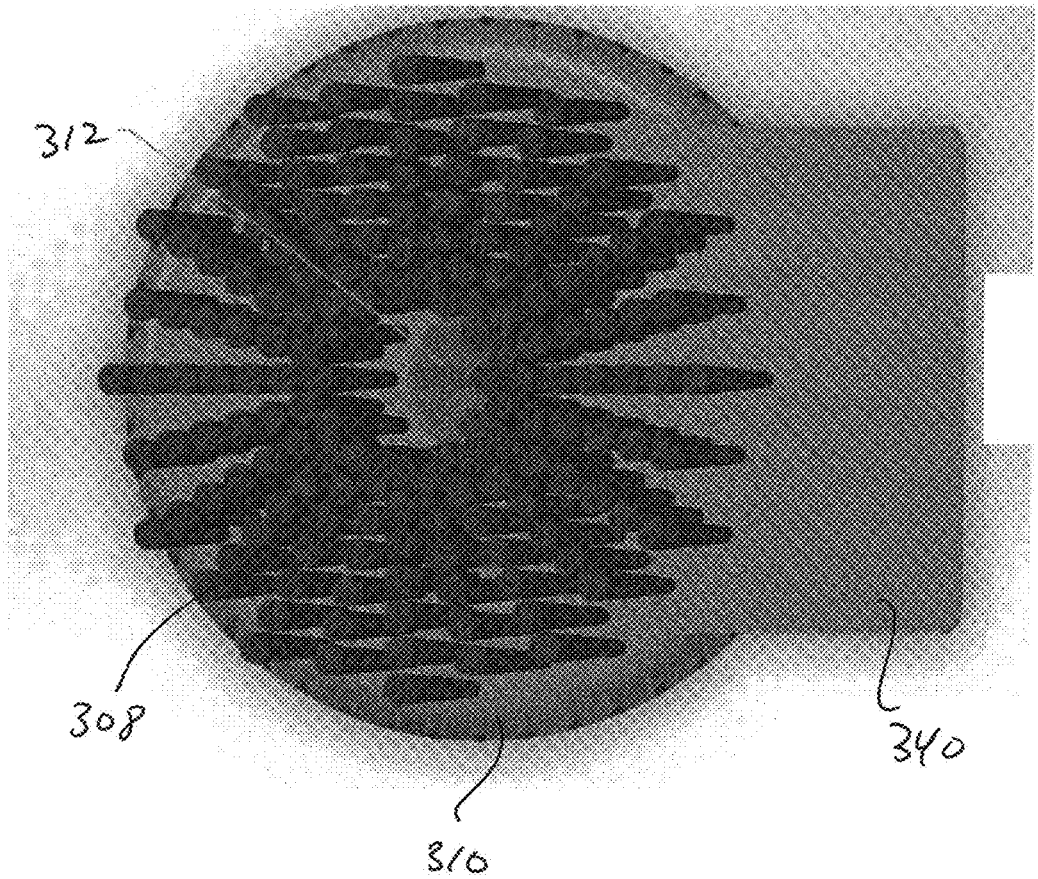
FIG. 22 is a top plan view of FIG. 21.

FIGS. 21 and 22 show yet another embodiment of the present invention, wherein the cap 310 has an integrated scraper 340. Again, the scraper 340 allows for the cleaning system to be used in more ways, such as to remove large items from a club head. The scraper 340 may also include a downwardly extending portion somewhat like the scraper shown in the previous figures. In this example, the downwardly extending scraper may have a plurality of bristles that are designed to remain dry and remove larger and stubborn debris from a club head. Thereafter, the item being cleaned could be exposed to the softer and wet bristles of the cap 310.

For exemplary purposes only, most embodiments of the present invention described herein have been directed toward golf equipment cleaning devices. However, the present invention should not be limited to only these cleaning devices. The present invention is applicable to any device that may benefit from present invention and the devices described herein. For example, embodiments of the present invention may be utilized on a hot day to cool one's temperature or to clean other sports equipment such as baseball or lacrosse equipment.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about" or "approximately."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. A cleaning device, comprising:

a container adapted for holding fluid having an opening and an outlet;

a pump device connected to said opening of said container;

a hose having a proximal end connected to said outlet of said container;

a valve interconnected to a distal end of said hose, wherein said container, said pump device, said hose, and said valve at least partially define a hermetically sealable volume;

a brush connected to said hose, said brush comprising at least one brush outlet to dispense said fluid when said valve is opened;

wherein said brush comprises;

a primary valve stem having a proximal end and a distal end, said proximal end of said primary valve stem being connected to said valve;

a first substantially planar member hingedly connected to a distal end of said primary valve stem;

a second substantially planar member hingedly connected to said distal end of said primary valve stem, wherein said second substantially planar member is disposed opposite said first substantially planar member;

a first plurality of bristles disposed on an inner surface of said first substantially planar member;

a second plurality of bristles disposed on an inner surface of said second substantially planar member; and wherein said first and second substantially planar members are rotatable such that said first and second plurality of bristles may overlap.

2. The cleaning device of claim 1, further comprising a third plurality of bristles disposed on a distal end of said third stem, wherein a portion of said fluid flows through said primary valve stem, through said third stem, and past said third plurality of bristles.

3. The cleaning device of claim 2, wherein said first plurality of bristles, said second plurality of bristles, and said third plurality of bristles are oriented about a radius of curvature, wherein said radius of curvature is between approximately 0.5 inches and 2.5 inches.

4. The cleaning device of claim 1, further comprising:

a second container having a second container outlet;

a second hose connected to said second container outlet, and a Y connection of said second hose, wherein said second container is in fluid communication with said hose; and wherein an entrained fluid is adapted to be held within said second container, wherein when the fluid flows through said second hose, the entrained fluid is at least partially moved out of said second container and into contact with fluid flowing through said hose.

5. The cleaning device of claim 1 further comprising:

a heating element disposed about said primary valve stem of said brush, wherein engagement of said valve causes said heating element to heat said primary valve stem and the fluid.

6. The cleaning device of claim 1, further comprising:

a pedal operatively connected to said valve, wherein a user may depress said pedal to open said valve.

7. The cleaning device of claim 1, further comprising:

a handle disposed about said primary valve stem, wherein said valve is disposed within said handle, said valve comprising an actuator that protrudes through said handle.

* * * * *